US006681943B2

(12) United States Patent
Barker et al.

(10) Patent No.: US 6,681,943 B2
(45) **Date of Patent: *Jan. 27, 2004**

(54) RAILCAR DRAFT GEAR ASSEMBLY AND SYSTEM

(75) Inventors: Ronald E. Barker, Somonauk, IL (US); Charles E. Burkhart, Millerstown, PA (US); Marlin E. Clark, Etters, PA (US); John F. Deppen, New Cumberland, PA (US); V. Terrey Hawthorne, Lisle, IL (US); Horst T. Kaufhold, Aurora, IL (US); Jay P. Monaco, Mechanicsburg, PA (US); Julius I. Pershwitz, Grantham, PA (US); John J. Steffen, Aurora, IL (US)

(73) Assignee: Amsted Industries Incorporated, Chicago, IL (US)

( * ) Notice: Subject to any disclaimer, the term of this patent is extended or adjusted under 35 U.S.C. 154(b) by 19 days.

This patent is subject to a terminal disclaimer.

(21) Appl. No.: 10/057,873

(22) Filed: Jan. 29, 2002

(65) Prior Publication Data

US 2002/0070189 A1 Jun. 13, 2002

Related U.S. Application Data

(62) Division of application No. 09/657,297, filed on Sep. 7, 2000.

(51) Int. Cl.[7] ..... B61G 7/10

(52) U.S. Cl. ..... 213/75 R; 213/46 R

(58) Field of Search ..... 213/49, 43, 46 R, 213/46 A, 47, 51, 75 R, 32 C, 32 R, 22; 188/314, 322.17, 322.16; 267/219; 277/500, 549, 550, 585, 586, 909

(56) References Cited

U.S. PATENT DOCUMENTS 1,292,862 A * 1/1919 O'Connor ..... 213/47
2,197,030 A * 4/1940 Clark ..... 213/46 R
2,791,337 A * 5/1957 Blattner ..... 213/45
2,876,911 A * 3/1959 Winther ..... 213/66
2,970,703 A * 2/1961 Blattner ..... 213/46 R
3,712,479 A * 1/1973 Atkinson ..... 213/47
3,840,126 A * 10/1974 Domer ..... 213/45
5,360,124 A * 11/1994 Wurzer et al. ..... 213/62 R
6,446,820 B1 * 9/2002 Barker et al. ..... 213/75 R

* cited by examiner

*Primary Examiner*—S. Joseph Morano
*Assistant Examiner*—Frantz F. Jules
(74) *Attorney, Agent, or Firm*—Edward J. Brosius

(57) ABSTRACT

A draft gear assembly is disclosed alone and in combination with a draft sill and a coupler. The draft sill has front and rear stops defining a draft gear pocket. The draft gear assembly has a yoke, a coupler follower, a rear follower, a front resilient member and a back resilient member. The yoke has top and bottom stops. The coupler follower is biased against the yoke top and bottom stops. The draft gear assembly also includes a center rod that extends through the yoke, through the back resilient member and through the rear follower. Prior to installation on a railcar, there is a shortening member on the center rod. The length of the assembly between the shortening member and the front of the coupler follower is slightly less than the longitudinal length of the draft gear pocket. After installation, the rear follower is positioned against rear stops of the draft sill. After installation, the yoke, coupler and coupler follower each have a neutral position and a full buff position. The yoke and coupler also have a full draft position. The draft stroke of the coupler and yoke is 1¼ inches forward. The buff stroke of the coupler and coupler follower is at least 4¼ inches rearward, while the buff stroke of the yoke is 3 inches rearward. The center rod is free from compression throughout buff movement and free from tension throughout draft movement of the coupler and yoke.

18 Claims, 19 Drawing Sheets

13
36
37
94
40
50
72
10F
24F
66
98
48
98
45
32
90
30
92
98
44
100
28
72
26F
47
42
74
46
11
48
46

40
48
10F
11
72
50
75
24F
100
46
44
98
30
98
32
13
26F
34
86
75
28
37
67
36
90
38
82
86
39

RAILCAR DRAFT GEAR ASSEMBLY AND SYSTEM

This application is a division of Ser. No. 09/657,297 filed Sep. 7, 2000.

BACKGROUND OF THE INVENTION

The present invention relates to railcar coupling systems, and more particularly to draft gear assemblies used in conjunction with draft sills and couplers in railcars.

Draft gear assemblies form the connection between the couplers at the ends of adjoining railroad freight cars and the draft sills at the ends of the freight cars. The draft sills are commonly cast or fabricated sills that are mounted at the ends of the center sills of the railcar. The draft sills have a pair of front stops and a pair of rear stops, with a draft gear pocket between the stops. The draft gear assembly is received in the draft gear pocket.

Each draft gear assembly is connected to one coupler, and couplers of adjacent rail cars are connected to form the train. The train may be hundreds of cars long and drawn by one or more locomotives. Typically, there is a limited amount of slack or free movement allowed between the cars; generally there is about two (2) inches of slack. This slack permits the rail cars limited movement toward and away from each other in response to train action and yard impact events.

Train action events include, for example: locomotive start up and acceleration; dynamic braking; differences in braking forces of adjacent cars; and gravity-induced movement of the cars as the train moves onto and away from inclines. Yard impact events include "humping" of the individual cars to build the train in the yard; in humping, a car is pushed over a hump in the track in the yard, released and allowed to roll down the incline of the hump toward an awaiting car, during humping, the released cars can reach speeds of 4–10 mph and can severely impact the coupler of the awaiting car.

Train action events and yard impact events both subject the couplers of the cars to buff impacts, and train action events also subject the couplers of the cars to draft impacts. These impacts are transmitted from the couplers to the draft gear assemblies to the rail car body. That is, as the couplers are pulled or pushed, the movement is translated to the freight car body through the draft gear assemblies. Typical draft gear assemblies include a yoke element that is connected to the coupler through a pin or key, a coupler follower and a draft gear, as well as other elements. Generally, the coupler follower is positioned against or closely spaced from the butt end of the coupler in the draft gear pocket, within the yoke. The draft gear is positioned between the coupler follower and the rear stops of the draft sill; other elements, such as a wedge, may be interposed between the draft gear and the coupler follower.

In buff events, the butt end of the coupler moves inward against the coupler follower toward the rear stops of the draft sill. As the coupler and coupler follower are moved rearward, the shock of the movement is transferred to the draft gear. The draft gear typically absorbs and dissipates some of the energy from this shock through friction.

In draft events, slack is taken up between adjacent cars beginning at one end of the train and ending at the other end of the train. As a result of the slack being progressively taken up, the speed differences between the railcars increases as the slack at each coupler pair is taken up, with a resultant increase in buff and draft impacts on the couplers. For instance, during locomotive acceleration of a 50 car train from rest there is a total of 100 inches of slack between the 50 pairs of couplers in the train. This slack is taken up progressively, coupler pair by coupler pair. When the 2 inch slack in the coupler pair joining the last car to the train is taken up the next to the last car may be moving at a speed of 4 miles per hour. The slack in the last coupler pair is taken up very rapidly and the last two cars are subjected to a very large impact capable of injuring the lading or the car.

Various types of draft gear assemblies have been proposed and used. Some draft gear assemblies employ mechanical springs and steel friction members held in a steel housing that is received in a yoke. Other draft gear assemblies employ elastomer springs. However, those employing a steel housing add to the weight of the railcar. Those employing elastomer springs may be difficult to install and remove from standard draft sills.

SUMMARY OF THE INVENTION

The present invention addresses the problems incident to train action and yard impact events. The present invention addresses these problems in a manner that is useful in applications such as tank cars, grain cars and coal cars, where the lading need not be protected from damage but where it is desirable to protect the railcar from damage due to train action and yard impact events. The present invention may be used in other applications as well.

In one aspect, the present invention provides a draft gear assembly for use with railcars having coupler members. The draft gear assembly has front and back ends and comprises a yoke, a coupler follower, at least one front resilient member, and at least one back resilient member. The yoke has a back wall, a top wall extending from the back wall toward the front end of the draft gear assembly, and a bottom wall extending from the back wall toward the front end of the draft gear assembly. The coupler follower is positioned between the back wall of the yoke and the front end of the draft gear assembly. The front resilient member is positioned between the coupler follower and the back wall of the yoke. The back resilient member is positioned between the yoke back wall and the back end of the draft gear assembly. The front and back resilient members are compressible. The rear follower is positioned rearward of the back resilient member. The coupler follower has a buff stroke of 4¼ inches but does not move in draft. The yoke has a draft stroke of 1¼ inches.

In another aspect, the present invention provides a draft gear assembly for use with a railcar having a coupler member and a draft sill with front and rear stops defining a draft gear pocket to receive at least part of the draft gear assembly. The draft gear pocket has a length between the front stops and rear stops. The draft gear assembly has front and back ends and comprises a yoke having a back wall, a top wall extending from the back wall toward the front end of the draft gear assembly, and a bottom wall extending from the back wall toward the front end of the draft gear assembly. The draft gear assembly also has a coupler follower positioned between the back wall of the yoke and the front end of the draft gear assembly. The coupler follower has a forward facing stop surface. The draft gear assembly has at least one front resilient member positioned between the coupler follower and the back wall of the yoke and at least one back resilient member positioned between the yoke back wall and the back end of the draft gear assembly. There is a rear follower positioned rearward of the back resilient member. The rear follower has a rearward facing stop surface. A center rod extends through the rear follower, through the back resilient member and through the back wall of the yoke. Prior to installation on the railcar the yoke, coupler follower, front resilient member, back resilient member, rear follower and center rod comprise an assembly. This assembly further includes a shortening member on the center rod at the rear follower. The length of the assembly between the stop surface of the coupler follower and the stop surface of the rear follower is less than the length of the draft gear pocket. After installation on the railcar, the coupler follower is positioned against the front stops and the rear follower is positioned against the rear stops. After installation on the railcar the yoke has a neutral position, a full draft position forward of the neutral position, and a full buff position rearward of the neutral position. The center rod is free from tension when the coupler member is in the full draft position, is free from tension and compression when the coupler member is in the neutral position, and is free from compression when the coupler member is in the full buff position.

In another aspect, the present invention provides a draft gear assembly for use with a railcar having a coupler member and a draft sill. The draft gear assembly having front and back ends and comprises a yoke, a coupler follower, a rear follower, at least one front resilient member and at least one back resilient member. The yoke has a back wall, a top wall extending from the back wall toward the front end of the draft gear assembly, a bottom wall extending from the back wall toward the front end of the draft gear assembly, and a yoke stop. The coupler follower is positioned between the back wall of the yoke and the front end of the draft gear assembly. The coupler follower has a forward facing surface positioned against the yoke stop. The front resilient member is positioned between the coupler follower and the back wall of the yoke. The back resilient member is positioned between the yoke back wall and the back end of the draft gear assembly. The rear follower is positioned rearward of the back resilient member, the rear follower having a rearward facing stop surface. The draft gear assembly also includes a center rod extending through the rear follower, through the back resilient member and through the back wall of the yoke. The draft gear assembly also includes a shortening member on the center rod at the rear follower. The distance between the rearward facing stop surface of the rear follower and the forward facing stop surface of the coupler follower is no more than 24⅝ inches.

In another aspect, the present invention provides, in combination, a draft gear assembly, a coupler and a draft sill. The draft sill has a pair of front stops and a pair of rear stops. The draft gear assembly has front and back ends and comprises a yoke having a back wall, a top wall extending from the back wall toward the front end of the draft gear assembly, and a bottom wall extending from the back wall toward the front end of the draft gear assembly. The yoke has a buff stroke from a neutral position to a full buff position and a draft stroke from the neutral position to a full draft position. The back wall of the yoke is between the front and rear stops of the draft sill. The draft gear assembly also includes a coupler follower positioned between the back wall of the yoke and the front stops of the draft sill. The coupler follower has a buff stroke from the neutral position to a full buff position. A rear follower is positioned against the rear stops of the draft sill. The yoke back wall is longitudinally spaced from the rear follower. At least one front resilient member fills the longitudinal distance between the coupler follower and the back wall of the yoke. At least one back resilient member fills the longitudinal distance between the rear follower and the back wall of the yoke. A coupler extends forward from the yoke. The coupler has a neutral position, a draft stroke from the neutral position to a full draft position forward of the neutral position and a buff stroke from the neutral position to a full buff position back from the neutral position. The coupler and yoke have draft strokes such that the distance between the front face of the yoke back wall and the coupler follower decreases from the neutral spacing when the coupler is in the full draft position and the distance between the rear face of the yoke back wall and the rear follower increases from the neutral spacing when the coupler is in the full draft position. The coupler, yoke and coupler follower have buff strokes such that the distance between the front face of the yoke back wall and the coupler follower decreases from the neutral spacing when the coupler is in the full buff position and the distance between the rear face of the yoke back wall and the rear follower decreases from the neutral spacing when the coupler is in the full buff position. The coupler draft stroke is 1¼ inches and the coupler buff stroke is at least 4¼ inches.

In another aspect, the present invention provides in combination, a draft gear assembly, a coupler and a draft sill. The draft sill has a pair of front stops and a pair of rear stops. The draft gear assembly has front and back ends and comprises a yoke having a back wall, a top wall extending from the back wall toward the front end of the draft gear assembly, and a bottom wall extending from the back wall toward the front end of the draft gear assembly. The back wall of the yoke is between the front and rear stops of the draft sill. A coupler follower is positioned between the back wall of the yoke and the front stops of the draft sill. A rear follower is longitudinally spaced from the yoke back wall. At least one front resilient member fills the longitudinal distance between the coupler follower and the back wall of the yoke. At least one back resilient member fills the longitudinal distance between the rear follower and the back wall of the yoke. A center rod extends through the rear follower, back resilient member and back wall of the yoke. A coupler extends forward from the yoke. The coupler has a neutral position, a full draft position forward of the neutral position and a full buff position back from the neutral position. The rear follower is positioned against the rear stops of the draft sill when the coupler is at the full buff position, at the full draft position and at the neutral position.

DETAILED DESCRIPTION

Three embodiments of railroad freight car draft gear assemblies are illustrated in the accompanying figures, and two of those embodiments are illustrated in FIGS. 1–4 and 11–14 as installed within a railroad freight car draft sill, with couplers attached to the draft gear assembly.

The three illustrated embodiments show that the draft gear assembly of the present invention may be used with standard E-couplers and rotary dump couplers, as well as with couplers having E coupler heads and F shanks, for example. It should be understood that the principles of the present invention are also expected to be applicable to any other type of coupler system in present use or that may come into use in the future.

In the following description, like reference numbers have been used for like parts. In some cases, reference numbers are followed by the letter "F", "E" or "R". The letter "F" is used in combination with a reference number if the part or portion of the part is specific to the embodiment used with a standard F-shank coupler. The letter "E" is used in combination with a reference number if the part or portion of the part is specific to the embodiment used with a standard E-coupler. The letter "R" is used if the part is specific to the embodiment used with a standard rotary dump coupler.

Throughout this description, references are made to inboard, forward or front positions or directions, and to outboard, rear, back or rearward positions or directions. The terms outboard, forward and front should be understood to refer to the longitudinally outboard position or direction shown at 2 in FIGS. 14 and 11–14, toward the outside of the draft sill. The terms inboard, rear, back and rearward should be understood to refer to the longitudinally inboard position or direction, toward the center of the freight railcar, shown at 4 in FIGS. 14 and 11–14.

All of the embodiments of the draft gear assembly 10F, 10E, 10R of the present invention may be used in combination with standard couplers and draft sills to define coupler or draft systems. In all cases, the draft sill 12 may be cast or fabricated, and may have standard features. No modifications of the draft sill are necessary for use with the draft gear assemblies of the present invention.

Figure 3:
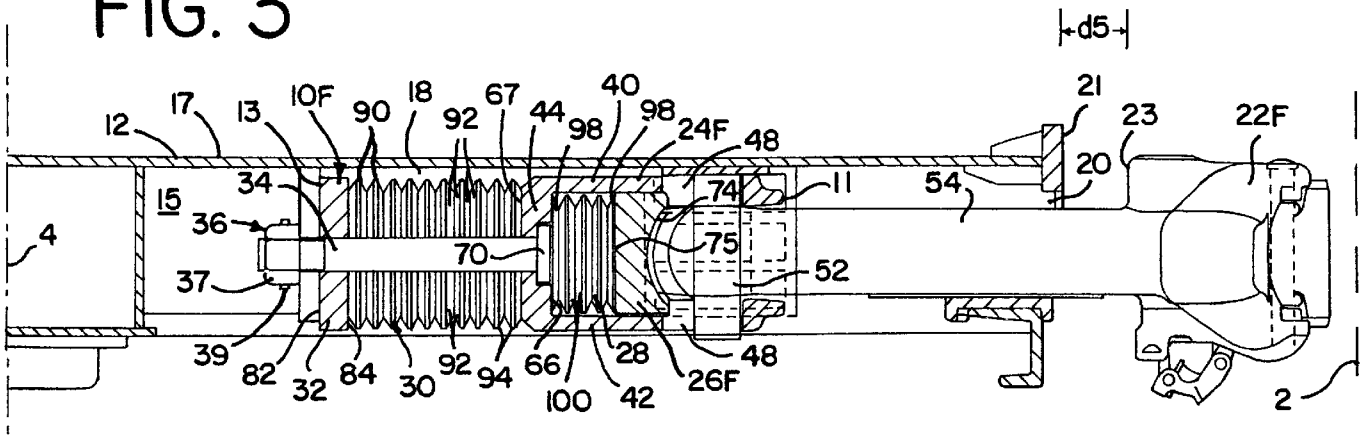
FIG. 3 is side elevation of the combination F-shank draft gear assembly, draft sill and F shank coupler of FIGS. 1–2, the coupler and draft gear assembly being shown in the neutral position and with parts shown in cross-section.

The draft sill 12 may have a pair of laterally spaced front stops 14 and a pair of laterally spaced rear stops 16 connected to spaced side walls 15. The front and rear stops 14, 16 are also longitudinally spaced apart. As shown in FIGS. 3 and 14, the illustrated draft sill also has a top wall 17, although the present invention may be used with draft sills lacking such a top wall. The front and rear stops 14, 16 define a draft gear pocket 18 between them. These draft sill features are illustrated in FIGS. 14 and 11–14. The draft sills may have other standard features and may be made of standard materials in standard ways. The illustrated draft gear assemblies may be used with standard cast or fabricated draft sills.

Figure 1:
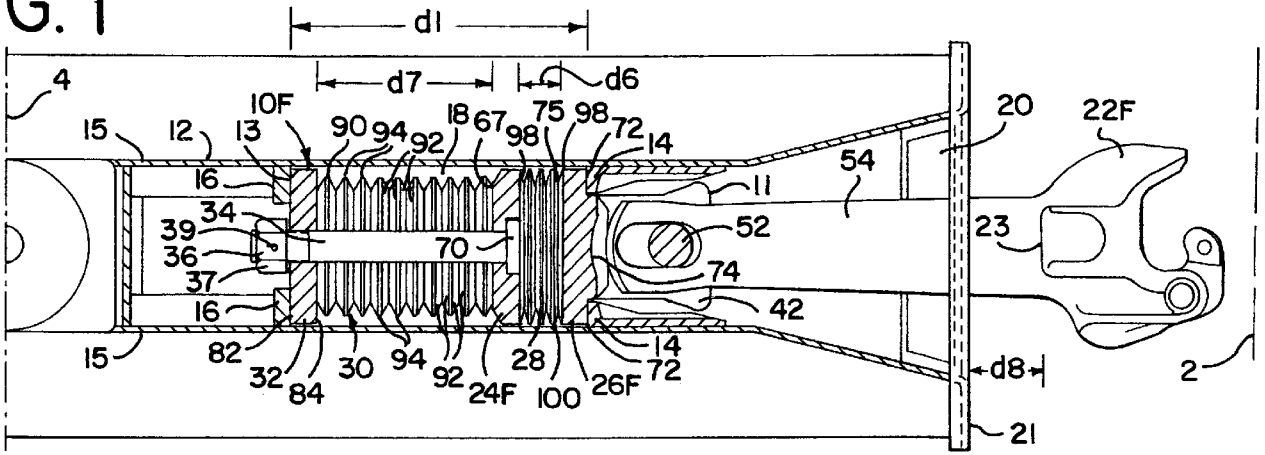
FIG. 1 is a top plan view of an F-shank draft gear assembly made in accordance with the principles of the present invention, shown installed in a draft sill and connected to a standard F shank coupler with an E-coupler head, the coupler and draft gear assembly being shown in a full draft position, and with parts shown in cross-section.
Figure 13:
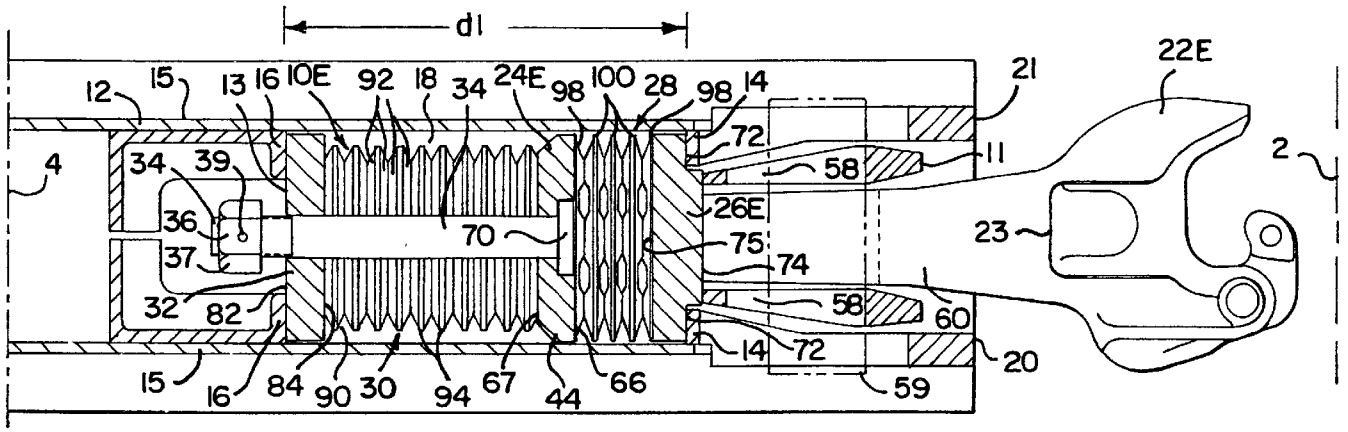
FIG. 13 is a top plan view of the combination E-shank draft gear assembly, draft sill and E coupler of FIGS. 11–13, the coupler and draft gear assembly being shown in the neutral position and with parts shown in cross-section.
Figure 14:
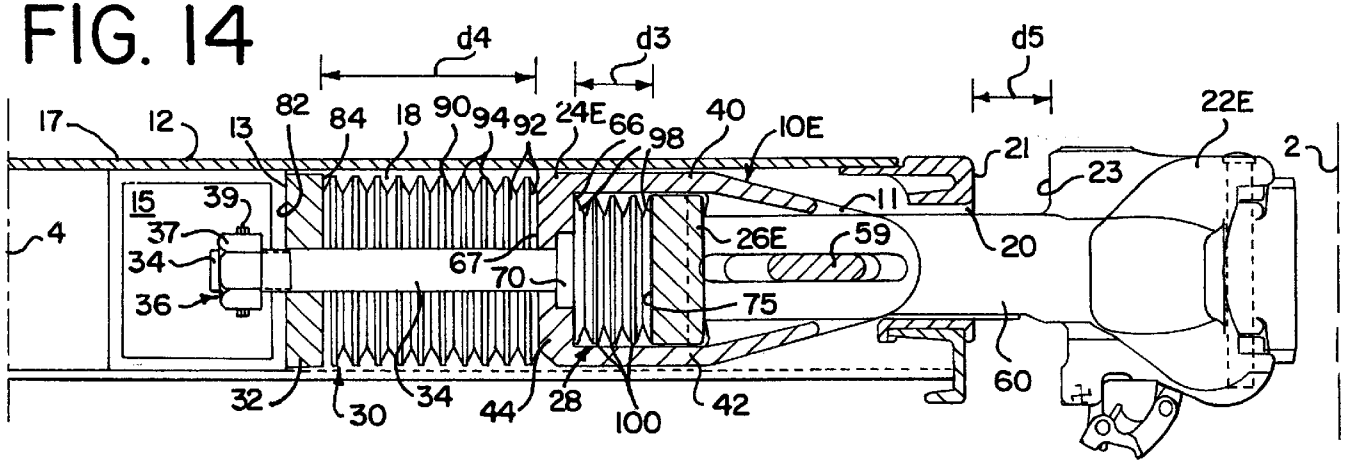
FIG. 14 is side elevation of the combination E-shank draft gear assembly, draft sill and E coupler of FIGS. 11–12, the coupler and draft gear assembly being shown in the neutral position and with parts shown in cross-section.

The draft gear pocket 18 is of the standard AAR size: the longitudinal distance between the inboard faces of the front stops 14 to the outboard faces of the rear stops 16 is 24⅝ inches, shown at d1 in FIGS. 1 and 13. All of the illustrated embodiments of the draft gear assembly 10F, 10E, 10R of the present invention may be retrofitted into existing standard draft sills with standard-sized draft gear pockets 18.

When installed, the front end 11 of each draft gear assembly 10F, 10E, 10R extends past the front stops 14 of the draft sill toward the longitudinal outboard end 20 of the draft sill and the back end 13 of the draft gear assembly is at the back stops 16 of the draft sill. Each draft gear assembly is connected to a standard coupler that extends in an outboard direction past the front end 21 (that is, the striker) of the draft sill. In FIGS. 1–4, the F-shank coupler (with an E coupler head in the illustrated embodiment) is shown at 22F. In FIGS. 11–14, the E coupler is shown at 22E. The rotary dump coupler is not illustrated. The draft gear assemblies 10F, 10E, 10R may each be used with a standard coupler having standard features and made of standard materials in standard ways. The standard couplers all have coupler horns shown at 23 in FIGS. 1–4 and 11–14.

Each of the illustrated draft gear assemblies 10F, 10E, and 10R include a yoke 24E, 24F, 24R, a coupler follower 26F, 26E, 26R, at least one front resilient member 28, at least one back resilient member 30, and a rear follower 32. Each draft gear assembly also includes a center rod 34 and a shortening member 36. Although the illustrated yokes and coupler followers differ for each of the illustrated types of couplers, the front resilient members 28, back resilient members 30, rear followers 32, center rods 34 and shortening members 36 are the same in each of the illustrated embodiments.

As can be seen in FIGS. 1–4 and 11–14, the draft systems of the present invention lack any draft gear housing between the resilient members 28, 30 and the walls 15, 17 of the draft sill 12. Therefore, the weight of the draft system should be reduced as compared to typical all steel draft gear systems.

Figure 7:
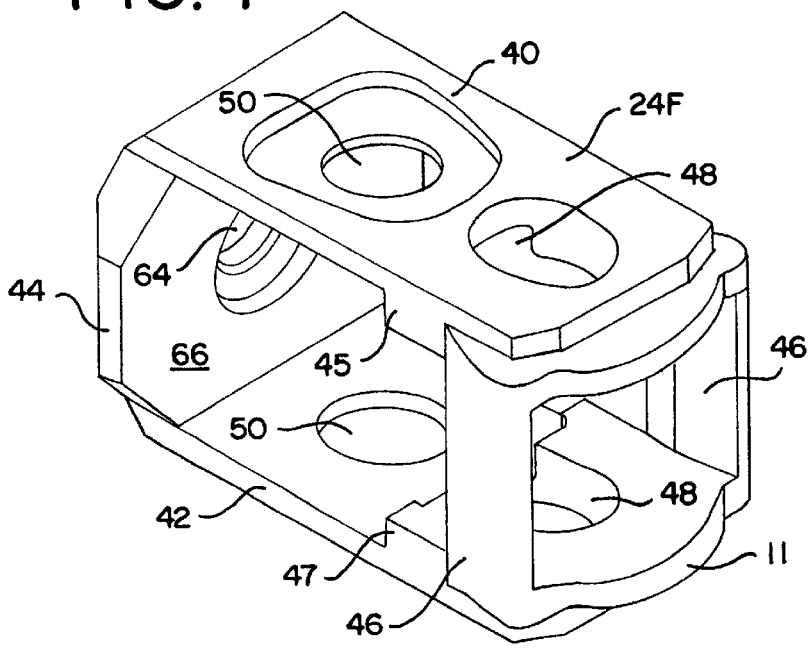
FIG. 7 is front perspective view of the yoke of the F-shank draft gear assembly of FIGS. 1–6.
Figure 17:
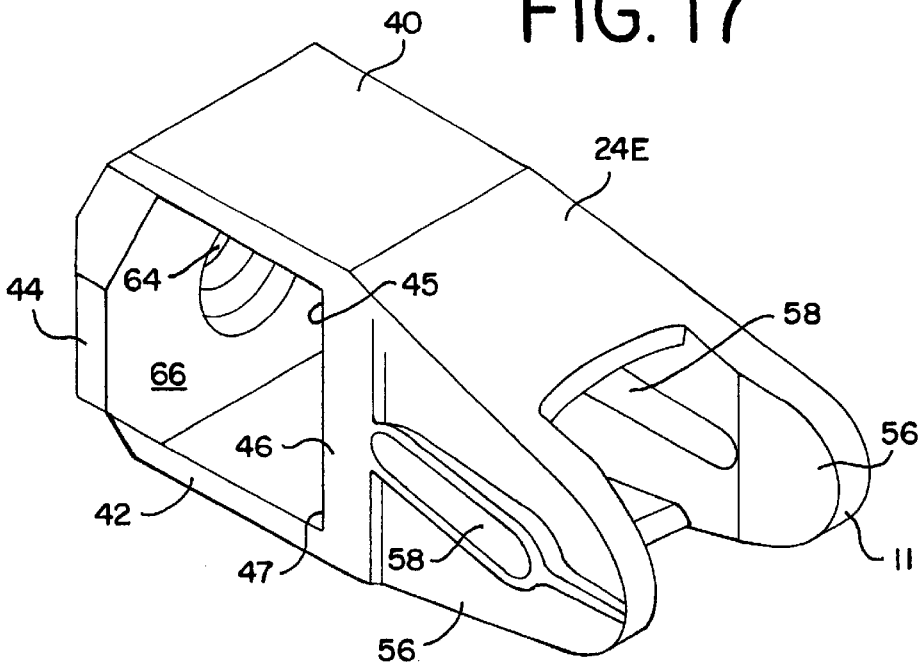
FIG. 17 is front perspective view of the yoke of the E-shank draft gear assembly of FIGS. 11–16.
Figure 21:
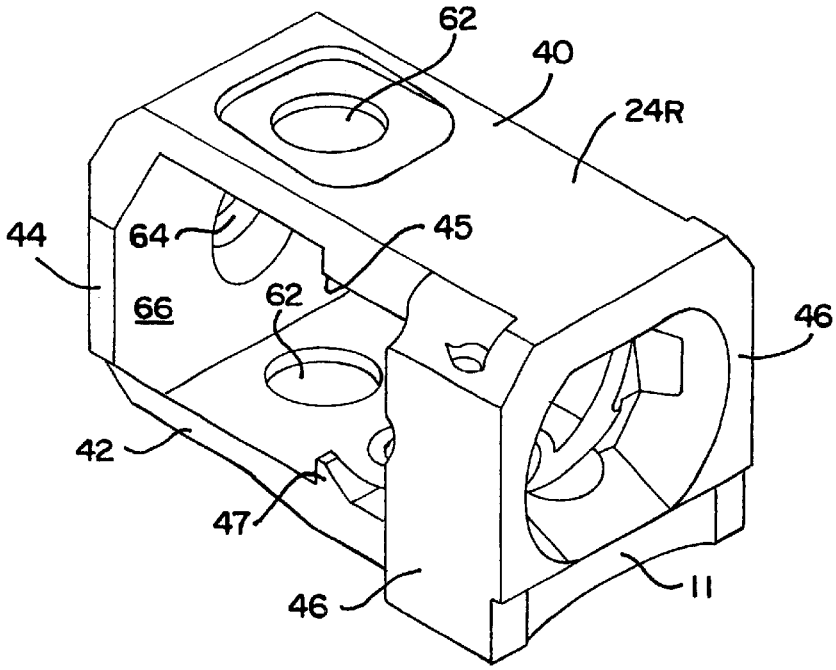
FIG. 21 is a front perspective view of the yoke of the rotary dump draft gear assembly of FIGS. 19–20.

As shown in FIGS. 7, 17 and 21, each yoke 24F, 24E, 24R has a top wall 40, an integral bottom wall 42 and an integral back wall 44. The top wall 40 and bottom wall 42 are connected at the back end by the back wall 44. The top wall 40 and bottom wall 42 extend generally horizontally toward the front end 11 of the draft gear assembly. The back wall 44 extends generally vertically from the top wall 40 to the bottom wall 42. Each yoke 24F, 24E, 24R also has front members 46 that extend generally vertically between the top wall 40 and bottom wall 42.

Figure 15:
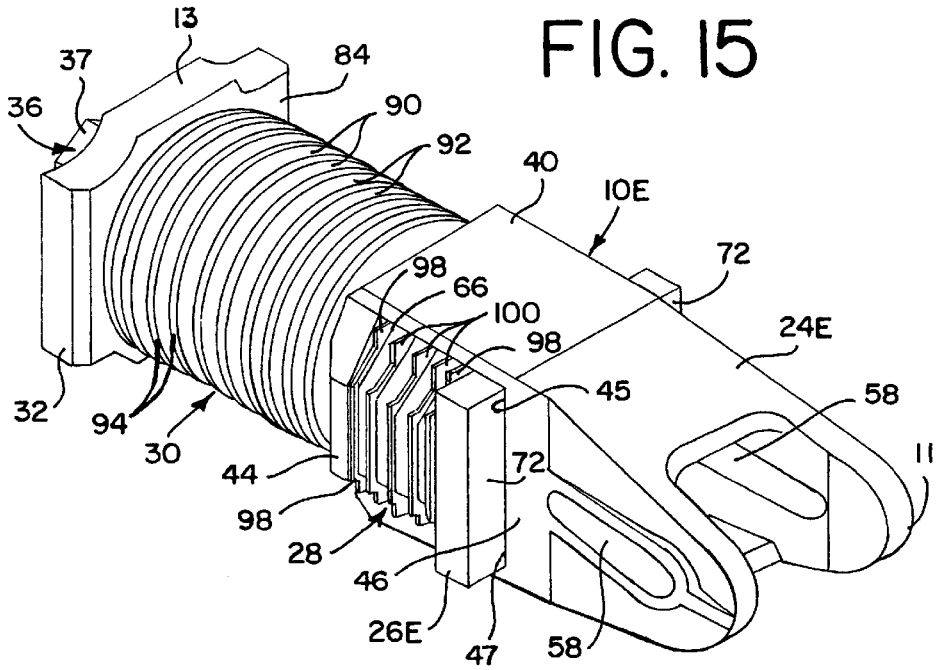
FIG. 15 is a front perspective view of an E-shank draft gear assembly for use with a draft sill and E coupler as shown in FIGS. 11–14, with the E-shank draft gear assembly being shown in a pre-shortened condition prior to installation in a draft sill.
Figure 16:
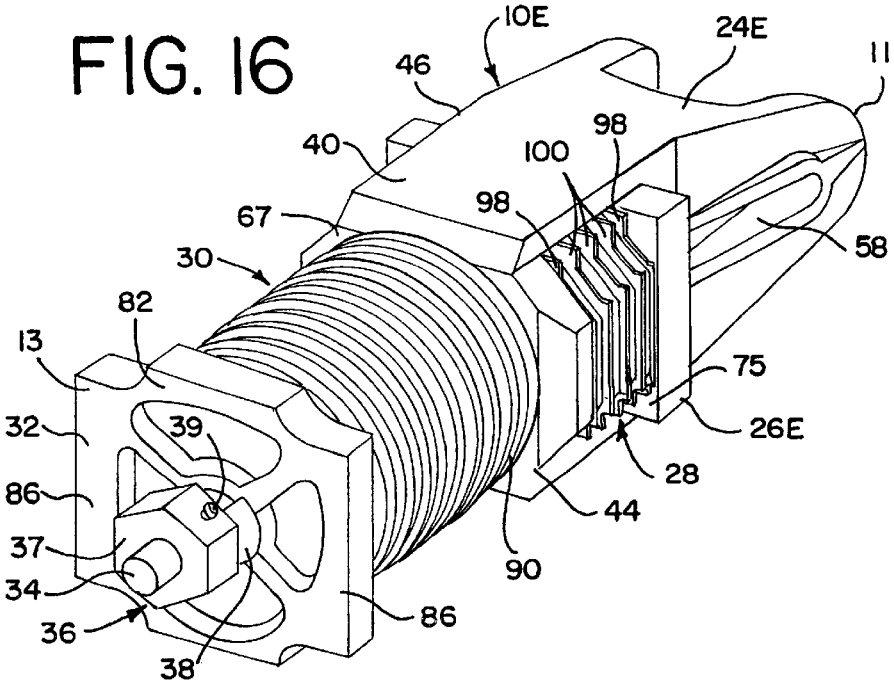
FIG. 16 is a back perspective view of the E-shank draft gear assembly of FIG. 15.

In the illustrated embodiment, the top wall 40 of each yoke also has a pair of laterally aligned top stops 45 extending downward. The top stops 45 are positioned longitudinally between the back wall 44 and the front end of the yoke. The bottom wall 42 of each yoke of the illustrated embodiment also has a pair of laterally aligned bottom stops 47 extending upward. The bottom stops 47 are positioned longitudinally between the back wall 44 and the front end of the yoke. The stops 45, 47 are aligned to provide co-planar inboard-facing stop surfaces, the plane of the stop surfaces being vertical and extending laterally through the yoke. As shown in FIGS. 15–17, the stops 45, 47 may comprise the vertical surfaces of the connecting elements 46.

The entire yoke 24 may comprise a steel casting, or it may be fabricated from separate steel components. The top and bottom walls 40, 42 are integral with the back wall 44 as well as with the connecting elements 46 and top and bottom stops 45, 47.

As shown in FIG. 7, in the yoke 24F of the first illustrated embodiment, the top wall 40 and bottom wall 42 have a pair of vertically-aligned forward holes 48 and a pair of vertically-aligned rearward holes 50. As shown in FIG. 3, when assembled with the coupler 22F, the coupler pin 52 extends through the vertically aligned forward holes 48 in the yoke and a vertically aligned hole in the coupler shank 54. As can also be seen in FIG. 3, the vertically aligned forward holes 48 of the yoke and the corresponding hole in the coupler shank have longitudinal dimensions greater than the diameter of the coupler pin 52. Thus, when the draft system is at the full buff position as in FIG. 2, there is substantially no contact between the coupler pin 52 and the portions of the top and bottom walls of the yoke at the inboard and outboard ends of the holes 48; in addition, there is substantially no contact between the coupler shank 54 and the coupler pin 52 so the coupler pin is not under stress. Similarly, when the draft system is in the neutral position shown in FIGS. 34, there is substantially no stress on the coupler pin 52. However, as described in more detail below, in the full draft position, the coupler pin 52 does contact the top and bottom walls 40, 42 of the yoke 24F to pull the yoke 24F with the coupler 22F. The coupler 22F and its shank may have standard features known in the art.

As shown in FIG. 7, the rearward vertically aligned holes 50 of the yoke 24F of the F-shank draft gear assembly 10F are surrounded by a depression in the top and bottom walls 40, 42 of the yoke 24F. The purpose of these rearward vertically aligned holes 50 and the surrounding depression is to reduce the weight of the yoke. The yoke can be made without these holes 50 and depressions.

Figure 11:
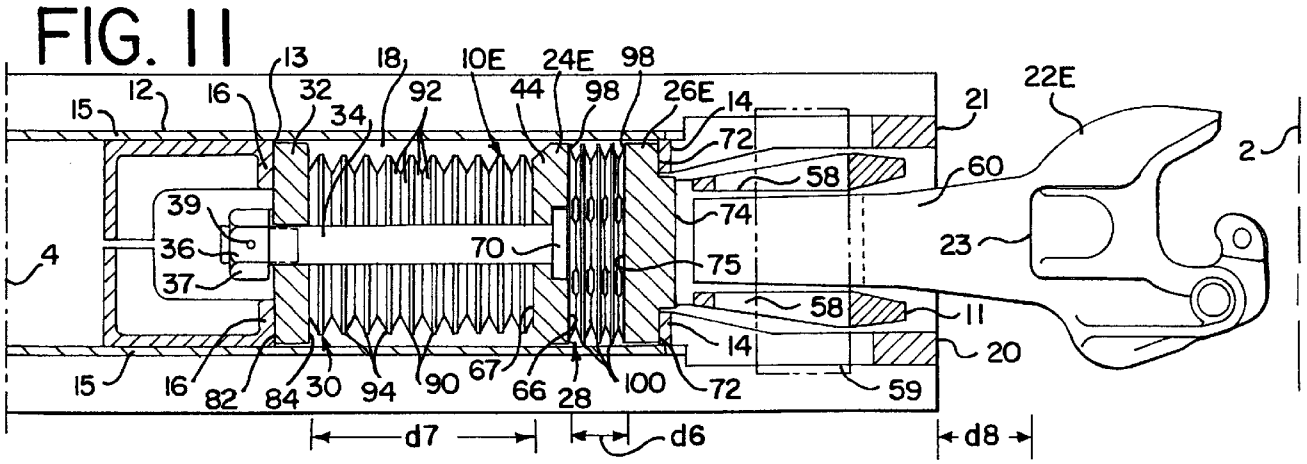
FIG. 11 is a top plan view of an E-shank draft gear assembly made in accordance with the principles of the present invention, shown installed in a draft sill and connected to a standard E coupler, the coupler and E-shank draft gear assembly being shown in a full draft position, and with parts shown in cross-section.
Figure 12:
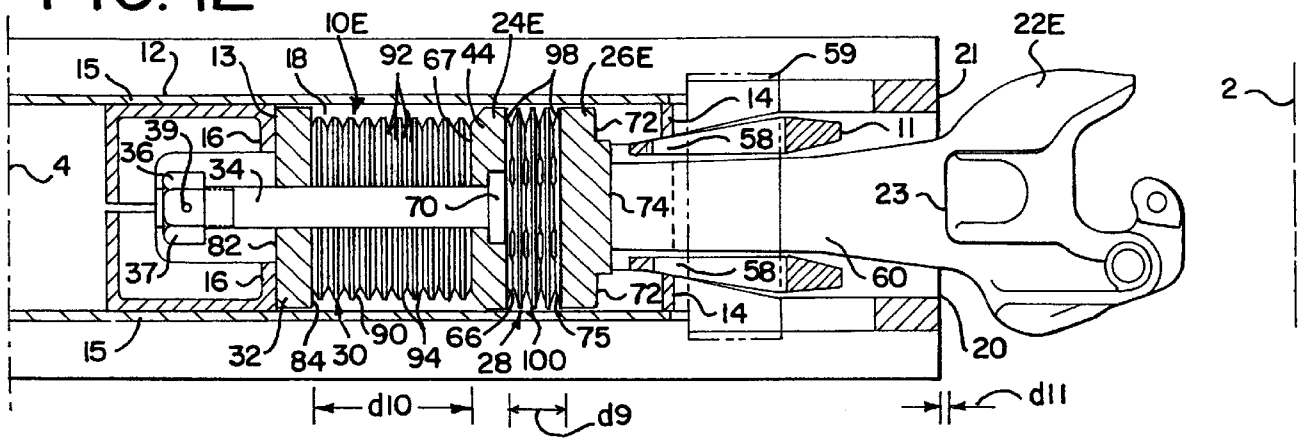
FIG. 12 is a top plan view of the combination E-shank draft gear assembly, draft sill and E coupler of FIG. 11, the coupler and draft gear assembly being shown in the full buff position, and with parts shown in cross-section.

As shown in FIG. 17, the yoke 24E of the E-shank draft gear assembly 10E includes features to allow the assembly to be used with an E coupler. The yoke 24E has a pair of spaced, forward-extending side walls 56. These side walls 56 have horizontally aligned key slots 58. As shown in FIGS. 11–13, these key slots 58 receive the coupler key 59 that also extends through a slot in the E coupler shank 60. The longitudinal dimensions of the slots 58 in the yoke side walls and the slot in the coupler shank 60 are great enough so that the key 59 does not contact the yoke walls 56 at the longitudinal inboard and outboard limits of the key slots 58 when the coupler assembly is in the full buff position and neutral position to prevent the key from undergoing any substantial stress during buff impacts. When the coupler assembly is in the full draft position shown in FIG. 11, the coupler 22E pulls the yoke 24E in the longitudinally outboard direction through the key 59.

As shown in FIG. 21, the rotary shank yoke 24R may have a pair of vertically aligned holes 62 in the top wall 40 and bottom wall 42 of the yoke near the back wall 44. The interior of the yoke at the outboard end may have standard features for receiving and retaining the butt end of the rotary dump coupler shank. The rotary dump coupler is not shown in the accompanying drawings, but may be a commercially available rotary coupler. The function of the holes 62 is to reduce the weight of the yoke 24R. The yoke 24R can be made without these holes 62.

The back wall 44 of each yoke 24F, 24E, 24R has a front-facing surface 66 and a back-facing surface 67. Each back wall 44 also has a central back hole 64 with a generally horizontal central longitudinal axis. As shown in FIGS. 7, 17 and 21, the front facing surface 66 of the back wall 44 may be countersunk around the central back hole 64. As shown in FIGS. 1–4 and 11–14, the center rods 34 of the draft gear assemblies 10F, 10E, 10R all extend from the inboard side through the holes 64.

Each center rod 34 has a head 70 that fits within the countersunk area around the back hole 64 in the yoke back wall 44. Each center rod 34 extends in a longitudinal inboard direction from the yoke back wall 44 through the back resilient member 30 and through the rear follower 32. At the inboard end of the center rod 34, a shortening member 36 is attached.

Figure 4:
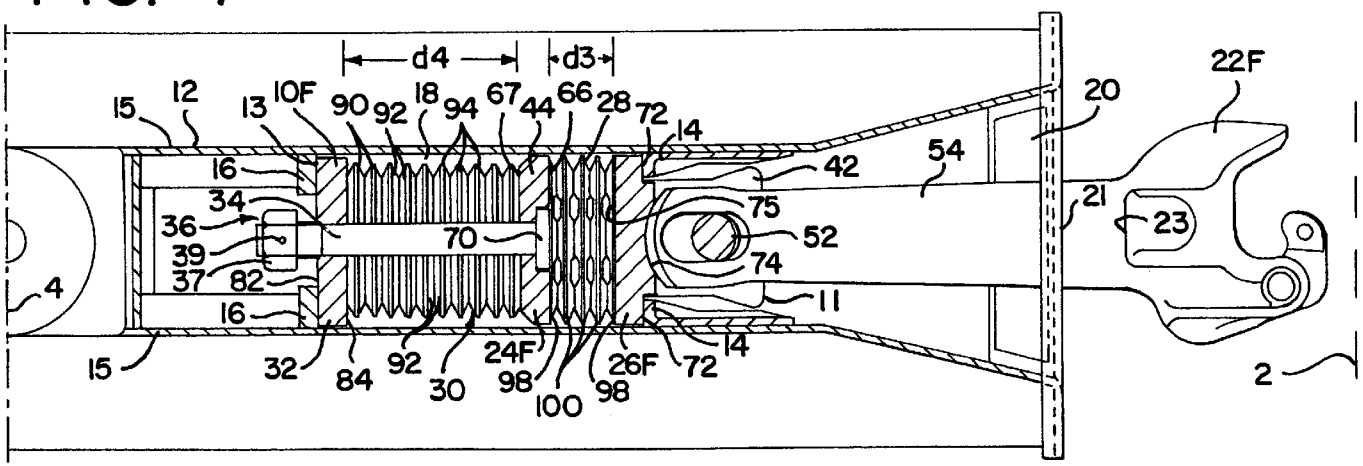
FIG. 4 is a top plan view of the combination F-shank draft gear assembly, draft sill and F shank coupler of FIGS. 1–3, the coupler and draft gear assembly being shown in the neutral position and with parts shown in cross-section.
Figure 5:
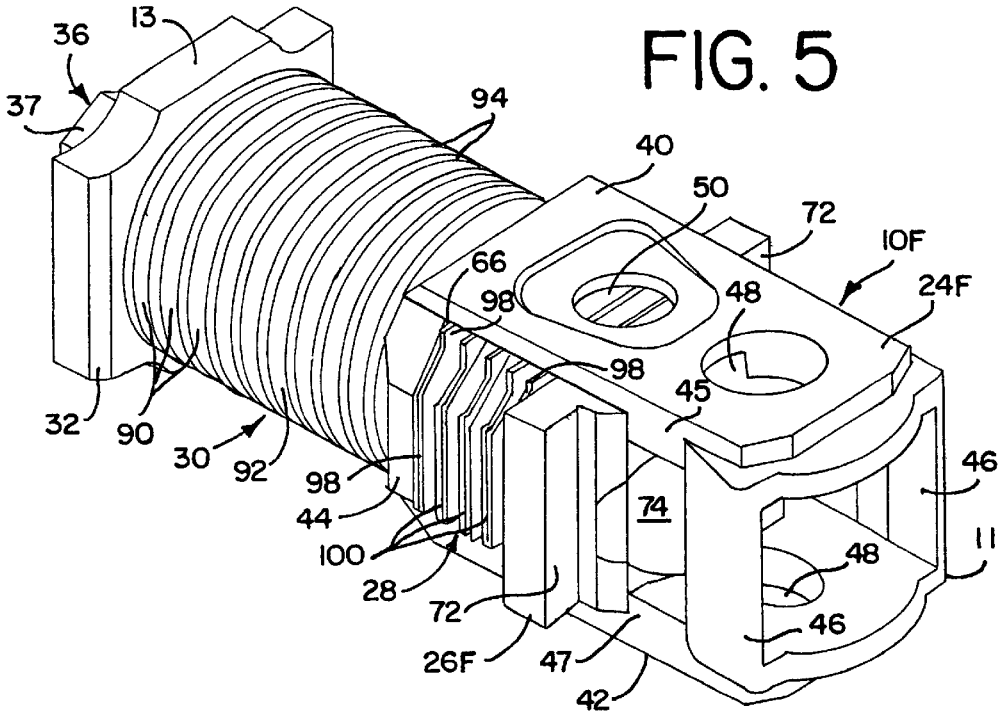
FIG. 5 is a front perspective view of an F-shank draft gear assembly for use with a draft sill and F-shank coupler as shown in FIGS. 1–4, with the F-shank draft gear assembly being shown in a pre-shortened condition prior to installation in a draft sill.
Figure 6:
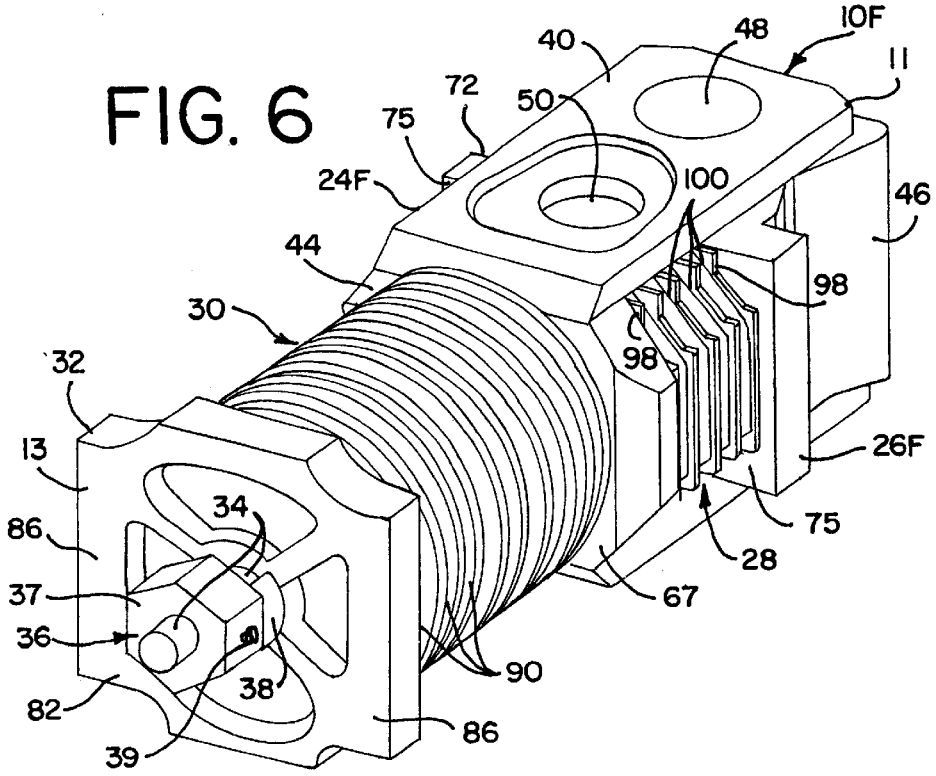
FIG. 6 is a rear perspective view of the F-shank draft gear assembly of FIG. 5.
Figure 20:
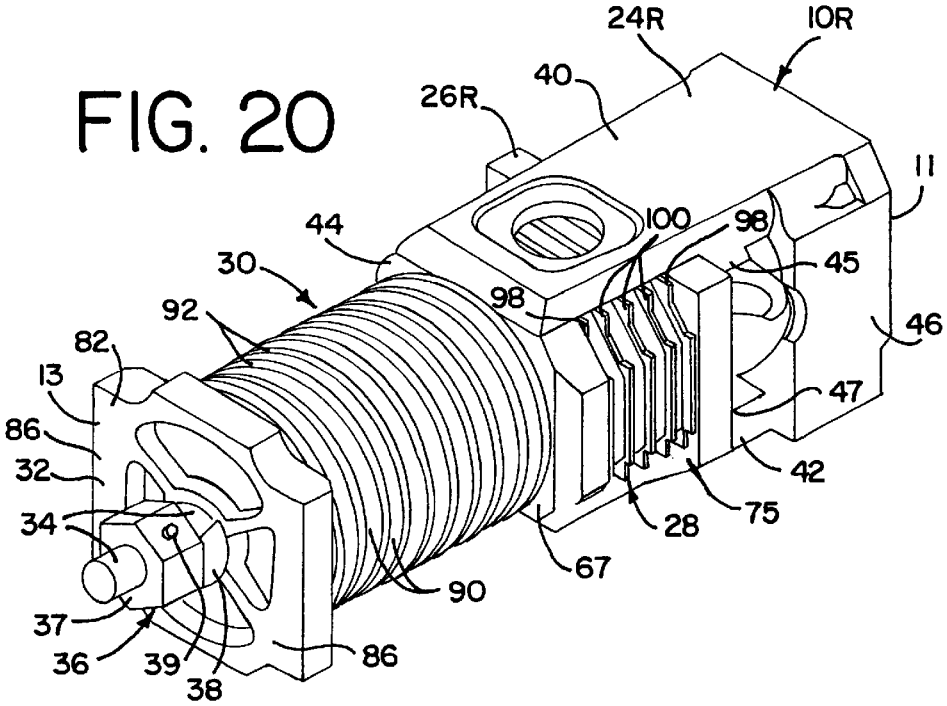
FIG. 20 is a back perspective view of the rotary dump draft gear assembly of FIG. 19.

In the illustrated embodiment, the shortening member 36 includes a nut 37, shown in FIGS. 1–6, 11–16 and 19–20, and a gag 38, shown in FIGS. 6, 16 and 20. The nut 37 is threaded onto the end of the center rod 34. The gag 38 comprises a semi-cylindrical metal spacer or collar. As described below, the gag 38 is a temporary element that is designed to fall off the draft gear assembly after the first buff impact. The nut 37 may remain on the center rod 34 throughout the life of the draft gear assembly, but only functions during installation and removal of the draft gear assembly from the draft gear pocket. Accordingly, the nut 37 may be removed if desired, but it is not necessary to remove it from the draft gear system. In the illustrated embodiment, the nut 37 includes a bore aligned with a bore in the center rod 34; a bolt 39 extends through these aligned bores as shown in FIGS. 3 and 4, perpendicular to the central longitudinal axis of the center rod 34.

The center rod 34 may have a length of 22 inches and a diameter of 2.5 inches. It may be made of mild steel. It should be understood that these dimensions and this material are provided by way of example only, and that the present invention is not limited to use of such a center rod unless expressly set forth in the claims.

In each illustrated draft gear assembly 10F, 10E, 10R, the coupler follower 26F, 26E, 26R is received within the yoke 24F, 24E, 24R between the top wall 40 and bottom wall 42. Each coupler follower is movable within the associated yoke in a forward and rearward direction. Prior to installation on the draft sill, forward movement of the coupler follower is limited by the yoke stops 45, 47 and rearward movement is limited by the compressibility of the front resilient member 28. After installation on the draft sill and during use, forward movement of the coupler follower is limited by the yoke stops 45, 47 and the draft sill front stops 14.

Figure 8:
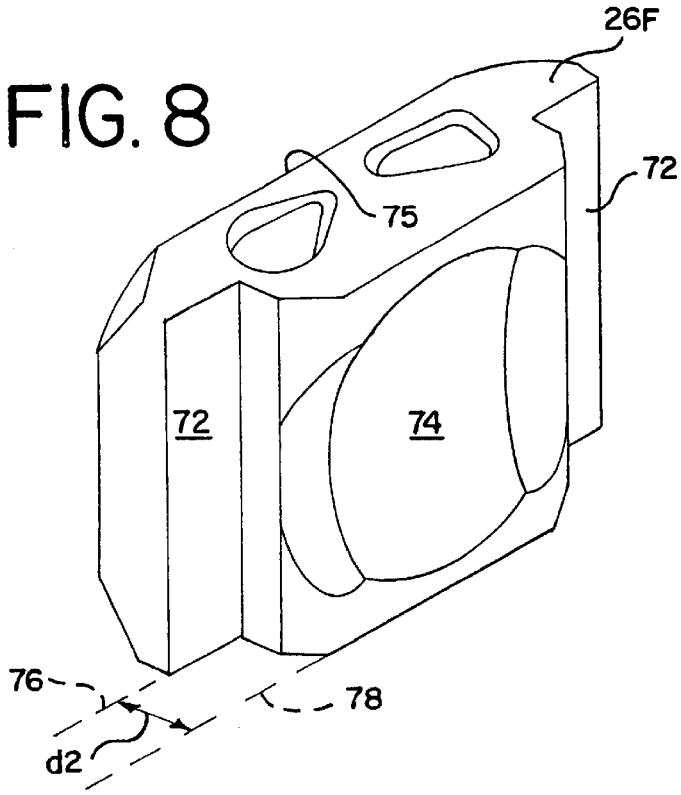
FIG. 8 is a front perspective view of the coupler follower of the F-shank draft gear assembly of FIGS. 1–6.
Figure 18:
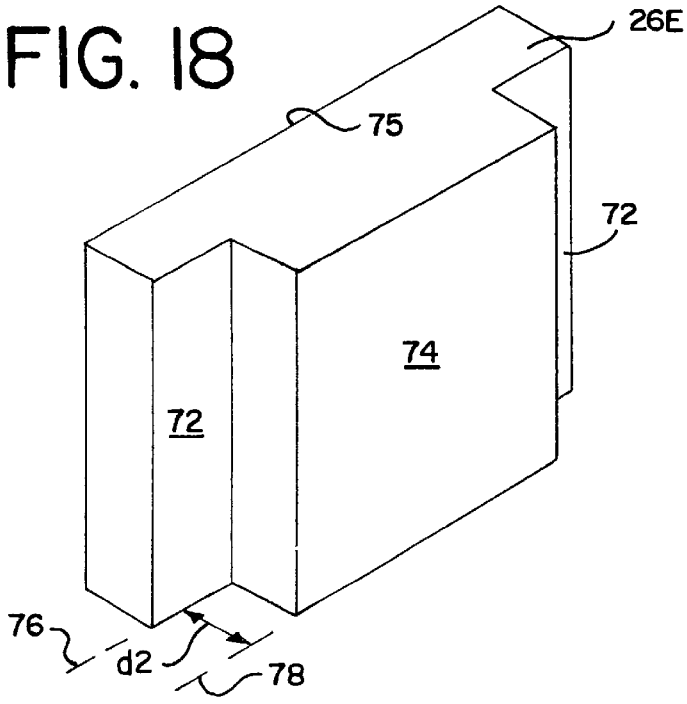
FIG. 18 is a front perspective view of the coupler follower of the E-shank draft gear assembly of FIGS. 11–16.
Figure 19:
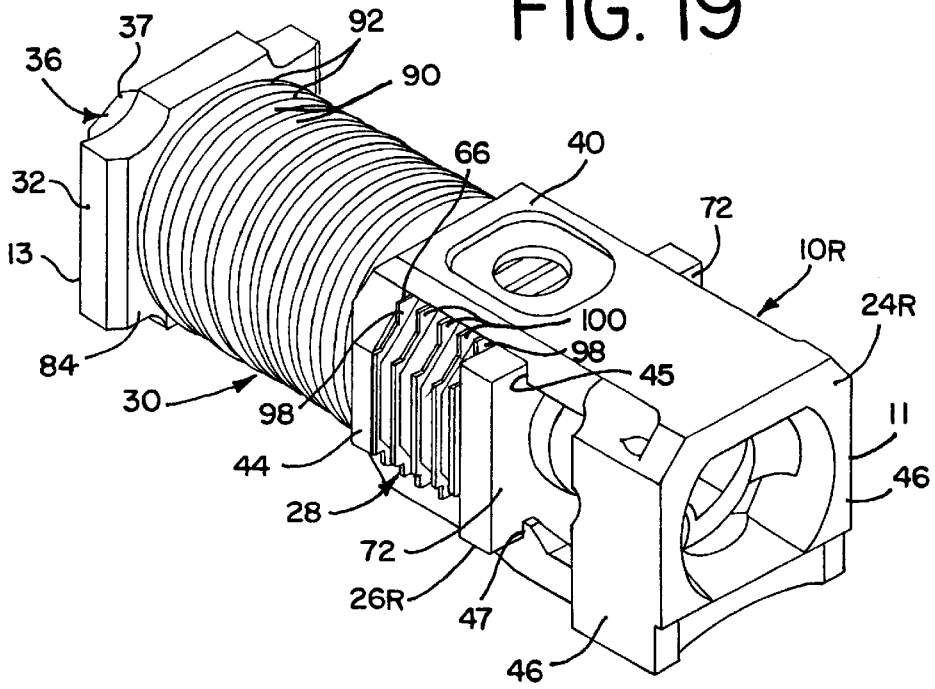
FIG. 19 is a front perspective view of a rotary dump draft gear assembly for use with a draft sill and rotary dump coupler, with the rotary dump draft gear assembly being shown in a pre-shortened condition prior to installation in a draft sill.
Figure 22:
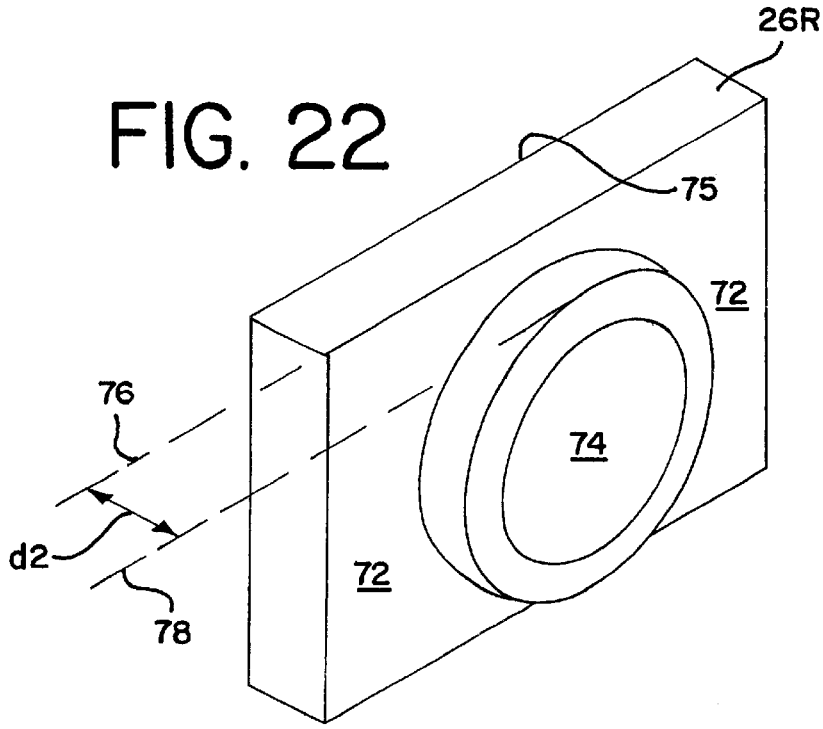
FIG. 22 is a front perspective view of the coupler follower of the rotary dump draft gear assembly of FIGS. 19–20.

Each of the illustrated coupler followers 26F, 26E and 26R has a pair of forward-facing stop contact surfaces 72, a forward-facing coupler bearing surface 74 and a rearward-facing back face 75. When installed in the draft sill 12, the stop contact surfaces 72 are generally vertical, and are adapted to contact the longitudinally inboard surfaces of the front stops 14 of the draft sill. The two stop contact surfaces 72 of each coupler follower are co-planar, and lie in plane 76 as illustrated in FIGS. 8, 18 and 22. As shown in FIGS. 5–6, 15–16 and 19–20, the stop contact surfaces 72 of the coupler followers 26F, 26E, 26R extend laterally beyond the edges of the top and bottom walls 40, 42 of the yokes 24F, 24E, 24R.

Each coupler bearing surface 74 of each coupler follower 26F, 26E, 26R is positioned laterally between the associated stop contact surfaces 72. The outboard-most part of each coupler bearing surface 74 lies in a plane 78 that is parallel to plane 76 of the contact surfaces 72; the two planes 76, 78 are spaced about 1¼ inches apart, as shown by distance d2 in FIGS. 8, 18 and 22. The shapes of the coupler bearing surfaces 74 may vary as illustrated in FIGS. 8, 18 and 22 to mate with the shape of the butt end of the associated coupler shank 54, 60. Either the surfaces 72 or the surface 74 may be designed to contact the yoke stop surfaces 45, 47. The coupler followers may be made of standard materials in standard ways, such as cast steel.

Figure 9:
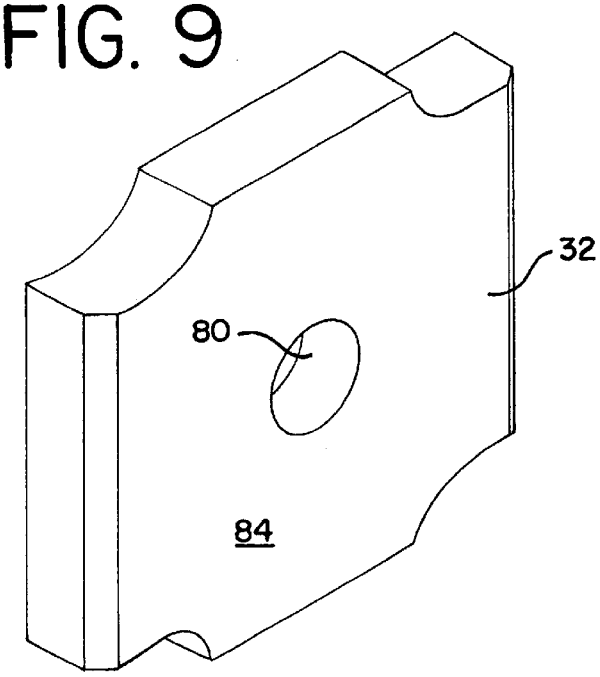
FIG. 9 is front perspective view of the rear follower of the draft gear assembly of FIGS. 1–6.
Figure 10:
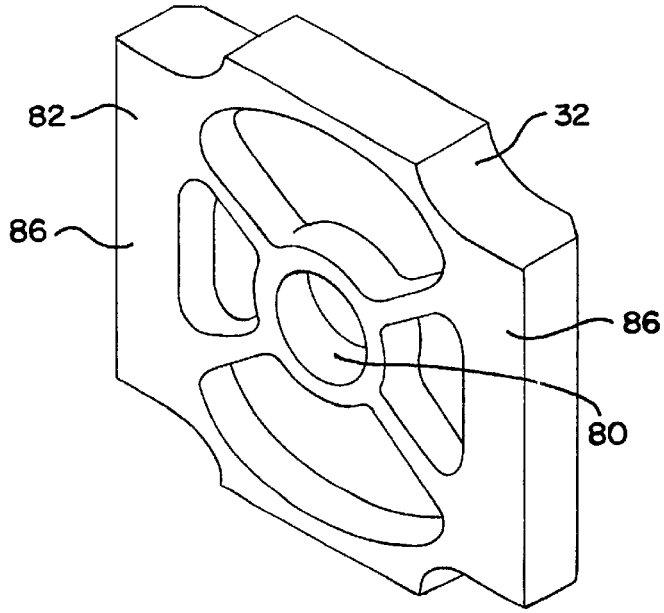
FIG. 10 is a back perspective view of the rear follower of the draft gear assembly of FIGS. 1–6.

In each of the illustrated embodiments, the same rear follower 32 may be used. As shown in FIGS. 9–10, each rear follower 32 includes a central hole 80, a back face 82 and a front face 84. Each back face 82 includes a pair of stop contact surfaces 86 that bear against the front-facing surfaces of the rear stops 16 of the draft sill 12. The rear follower may be made of standard materials in a standard manner, such as cast steel.

Each front face 84 of the rear follower 32 serves as a bearing surface for the back resilient member 30. Each back resilient member 30 extends between the front face 84 of the rear follower 32 and the rear face 67 of the yoke back wall 44. Each front resilient member 28 extends between the front face 66 of the yoke back wall 44 and the rear face 75 of the coupler follower 26F, 26E, 26R.

Figure 36:
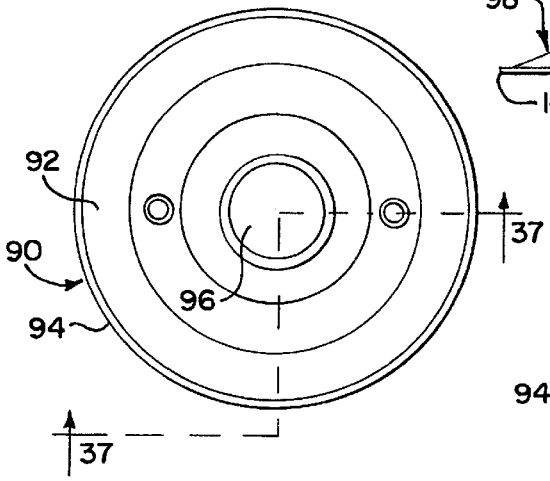
FIG. 36 is a front elevation view of one resilient ring member of the back resilient member of FIGS. 1–6, 11–16 and 19–20.
Figure 35:
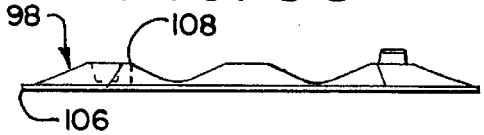
FIG. 35 is a top plan view of the end pad assembly of FIGS. 33–34.
Figure 37:
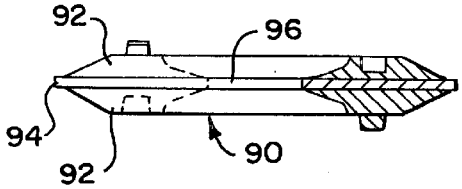
FIG. 37 is a view of the resilient ring member of FIG. 36 taken along line 37—37 of FIG. 36.

In the illustrated embodiments, the back resilient member 30 comprises a plurality of individual ring members 90 stacked in series. In the illustrated embodiments, there are ten individual ring members 90. As shown in FIGS. 36–37, each ring member 90 comprises two elastomer pads 92 bonded to a central steel ring plate 94. As shown in FIGS. 1–4 and 11–14, the elastomer pads 92 of adjacent ring members 90 bear against each other. As shown in FIG. 36, each ring member 90 has a hole 96 at its center, each hole having sufficient diameter for the center rod 34 to pass through. Each illustrated ring member 90 for the back resilient member is circular in elevation view, as shown in FIG. 36.

Figure 30:
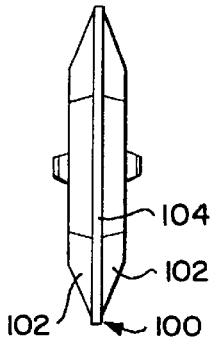
FIG. 30 is an end view of one intermediate pad assembly of the front resilient member of FIGS. 1–6, 11–16 and 19–20.
Figure 31:
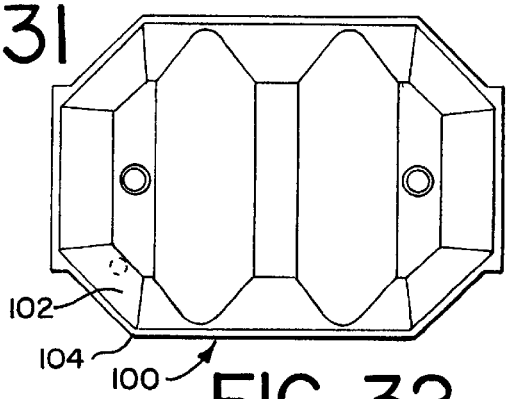
FIG. 31 is a front elevation view of the intermediate pad assembly of FIG. 30.
Figure 32:
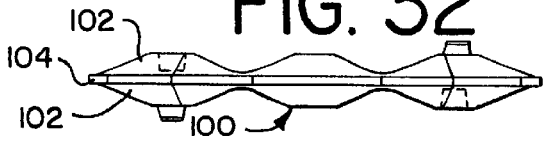
FIG. 32 is a top plan view of the intermediate pad assembly of FIGS. 30–31.
Figure 33:
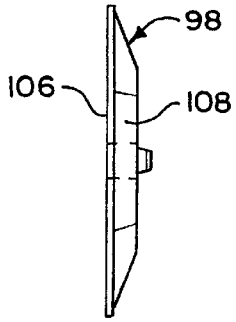
FIG. 33 is an end view of one end pad assembly of the front resilient member of FIGS. 1–6, 11–16 and 19–20.
Figure 34:
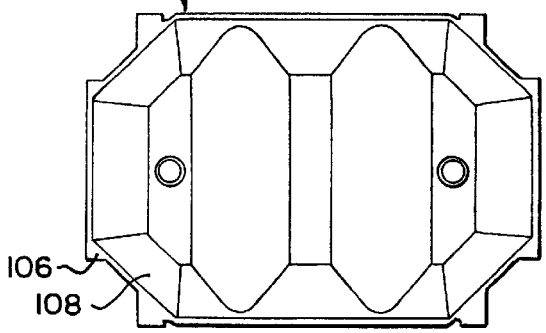
FIG. 34 is a front elevation of the end pad assembly of FIG. 33.

In the illustrated embodiments, the front resilient member 28 comprises a plurality of individual pad members stacked in series. In the illustrated embodiments, there are two end pad members 98 and three intermediate pad members 100. Each intermediate pad member 100, as shown in FIGS. 30–32, comprises two elastomer pads 102 bonded to a central steel plate 104. The elastomer pads 102 of adjacent intermediate pad members 100 bear against each other when stacked to form the back resilient member 28. Each end pad member 98 comprises a steel plate 106 bonded to a single elastomer pad 108. The steel plates 106 of the end pad members 98 bear against the coupler follower 26 and the back wall 44 of the yoke 24 and the end elastomer pads 108 bear against an adjacent elastomer pad 102 of an intermediate pad member 100. Each illustrated pad member 98, 100 for the front resilient member 28 is generally rectangular in elevation view, as shown in FIGS. 31 and 34.

The same material may be used for the elastomer pads 92, 102, 108 of both the front and back resilient members 28, 30. For example, a synthetic rubber such as styrene-butadiene rubber of the type marketed under the trademark KEYGARD by Keystone Industries, Inc., assignee of the present application, or a synthetic rubber of the type marketed under the trademark HYTREL by E. I. DuPont deNemours and Company. However, it should be understood that other materials may be used. Preferably, the material should be capable of withstanding temperatures of −40 to 160° F.; the elastic characteristics of the material are preferably maintained at both ends of the temperature spectrum.

It should be understood that although in the illustrated embodiments the two resilient members 28, 30 are made up of stacks of individual ring members 90 or pad members 98, 100, such a design in not necessary. For example, larger resilient members could be used.

Figure 23:
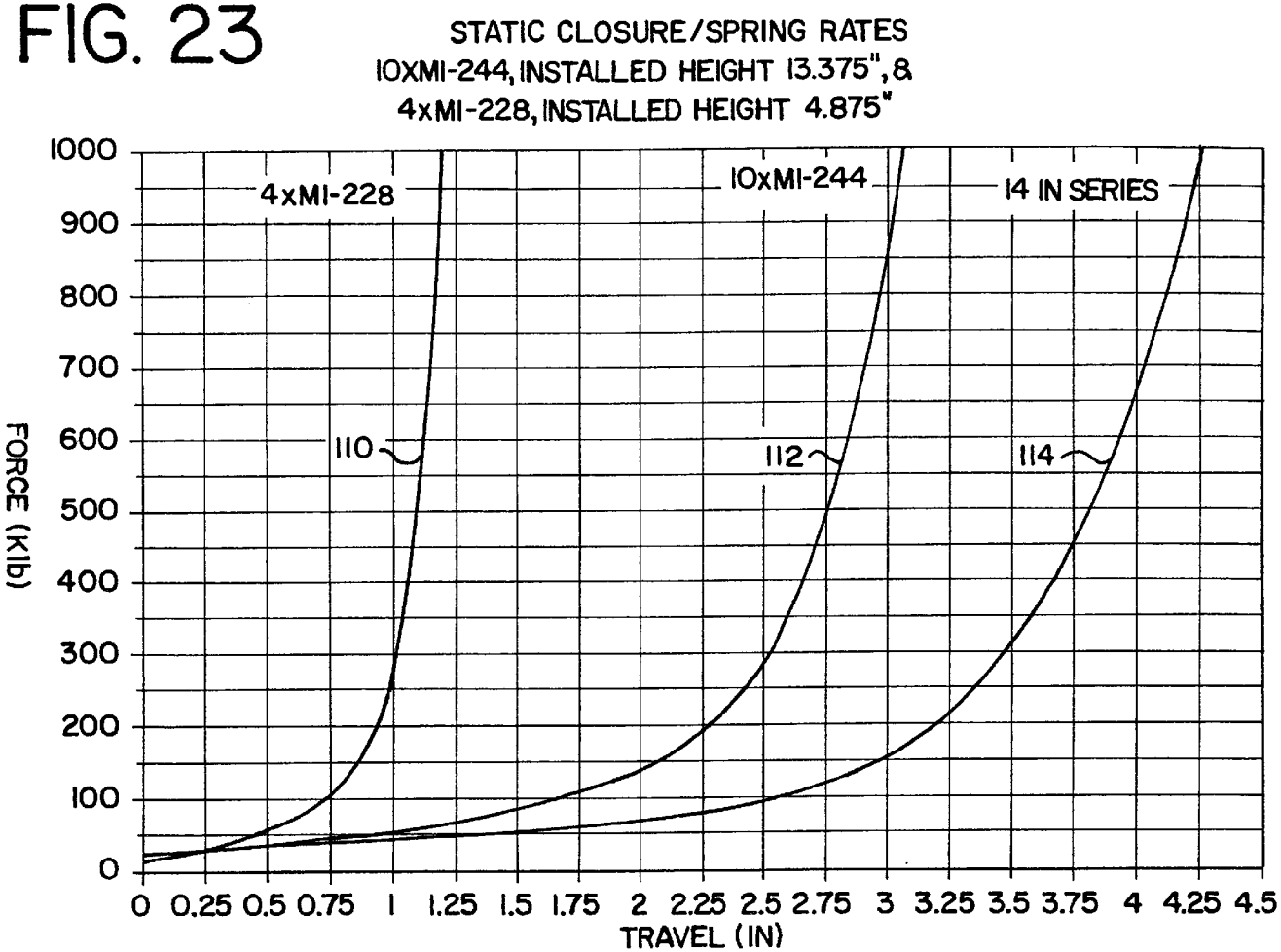
FIG. 23 is a graph showing the static closure characteristics or spring rates for resilient members that may be used in the draft assemblies shown in FIGS. 1–6, 11–16, and 19–20.
Figure 24:
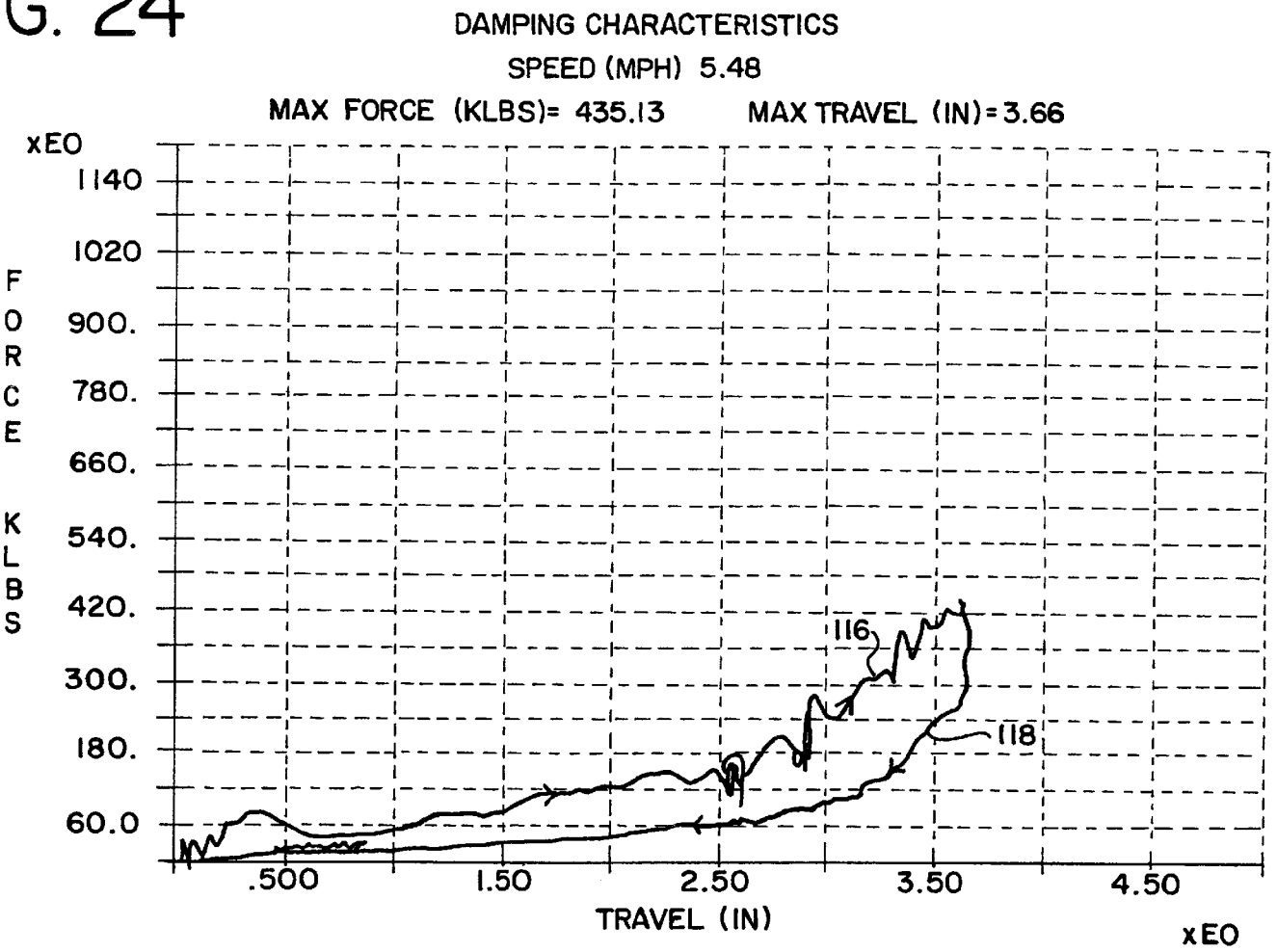
FIG. 24 is a graph showing the dynamic impact plots for buff impact of a draft gear assembly utilizing the principles of the present invention, with front and back resilient members operating in series, an impact speed of 5.48 mph, a maximum impact force of 435,130 pounds, and maximum coupler head travel of 3.66 inches.
Figure 25:
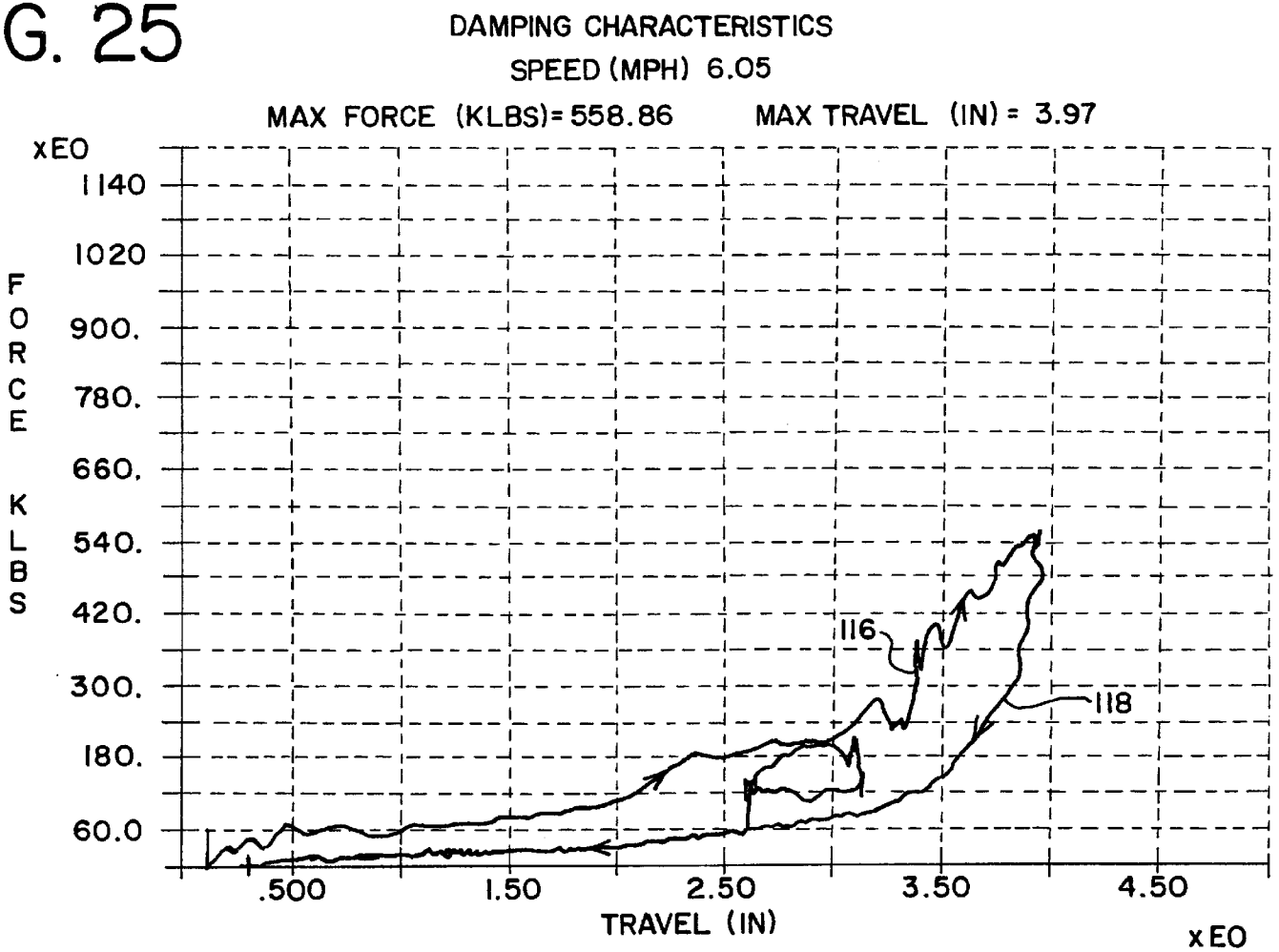
FIG. 25 is a graph showing the dynamic impact plots for buff impact of a draft gear assembly utilizing the principles of the present invention, with front and back resilient members operating in series, an impact speed of 6.05 mph, a maximum impact force of 558,860 pounds, and maximum coupler head travel of 3.97 inches.
Figure 26:
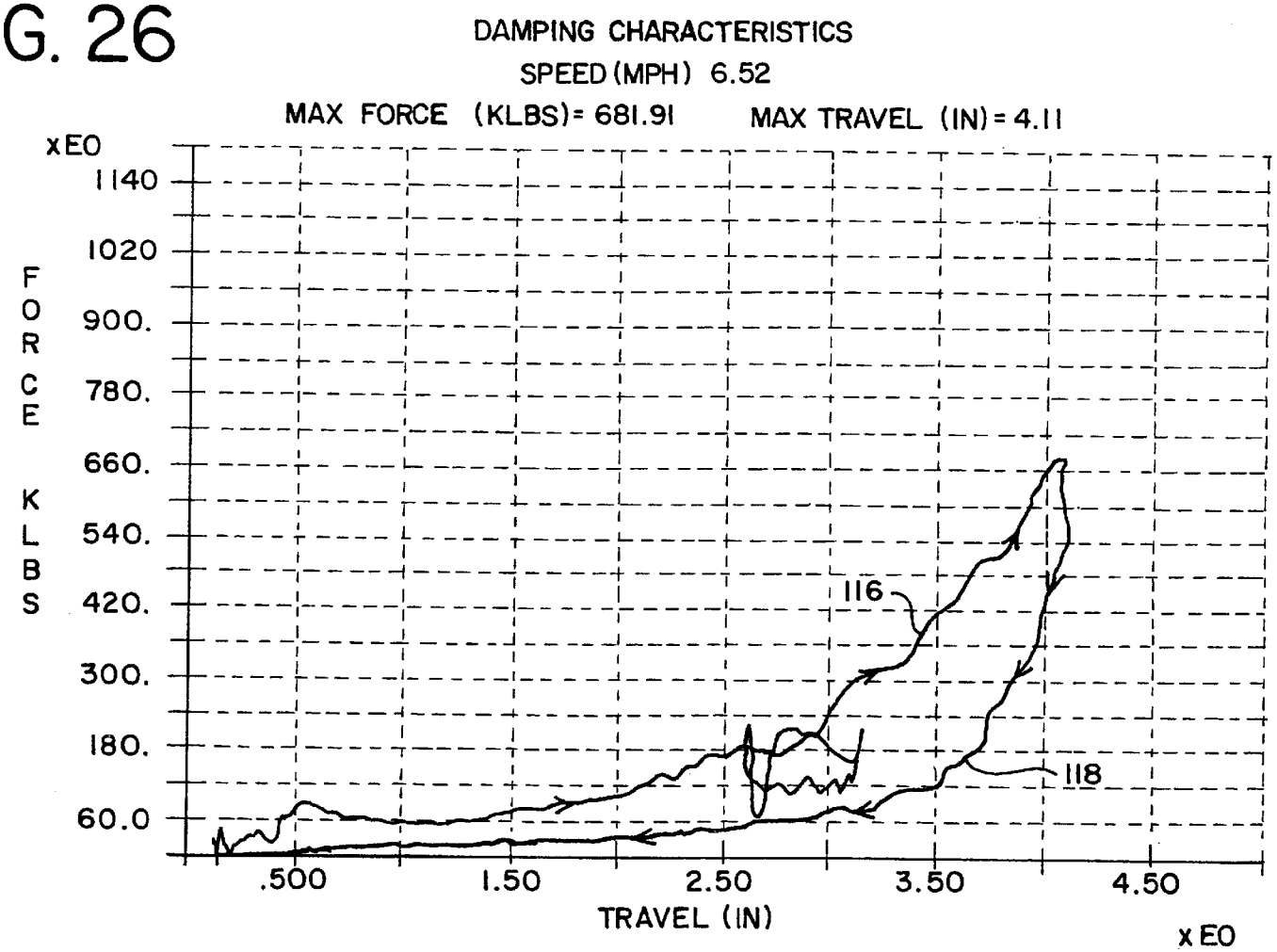
FIG. 26 is a graph showing the dynamic impact plots for buff impact of a draft gear assembly utilizing the principles of the present invention, with front and back resilient members operating in series, an impact speed of 6.52 mph, a maximum impact force of 681,910 pounds, and maximum coupler head travel of 4.11 inches.
Figure 27:
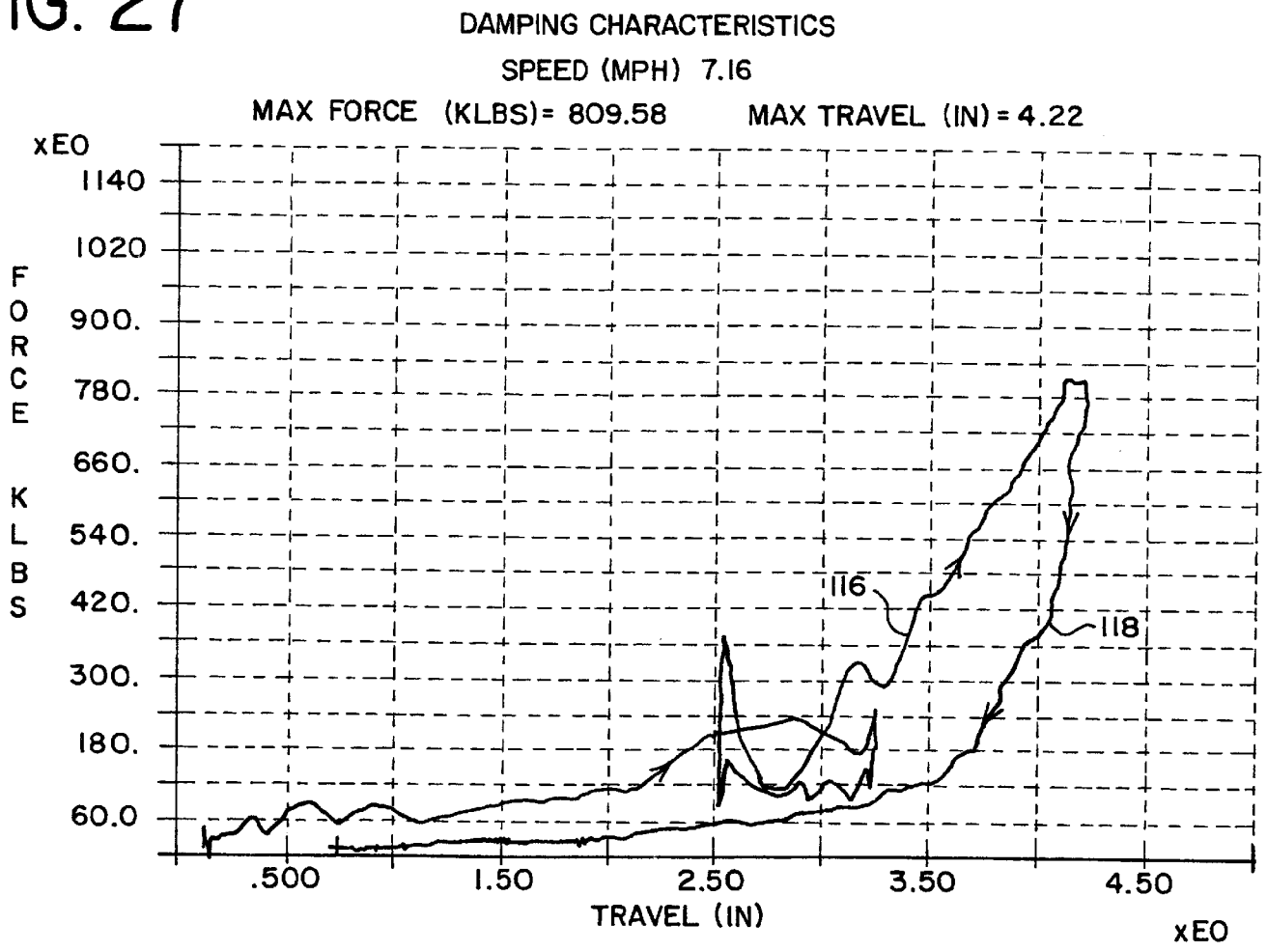
FIG. 27 is a graph showing the dynamic impact plots for buff impact of a draft gear assembly utilizing the principles of the present invention, with front and back resilient members operating in series, an impact speed of 7.16 mph, a maximum impact force of 809,580 pounds, and maximum coupler head travel of 4.22 inches.
Figure 28:
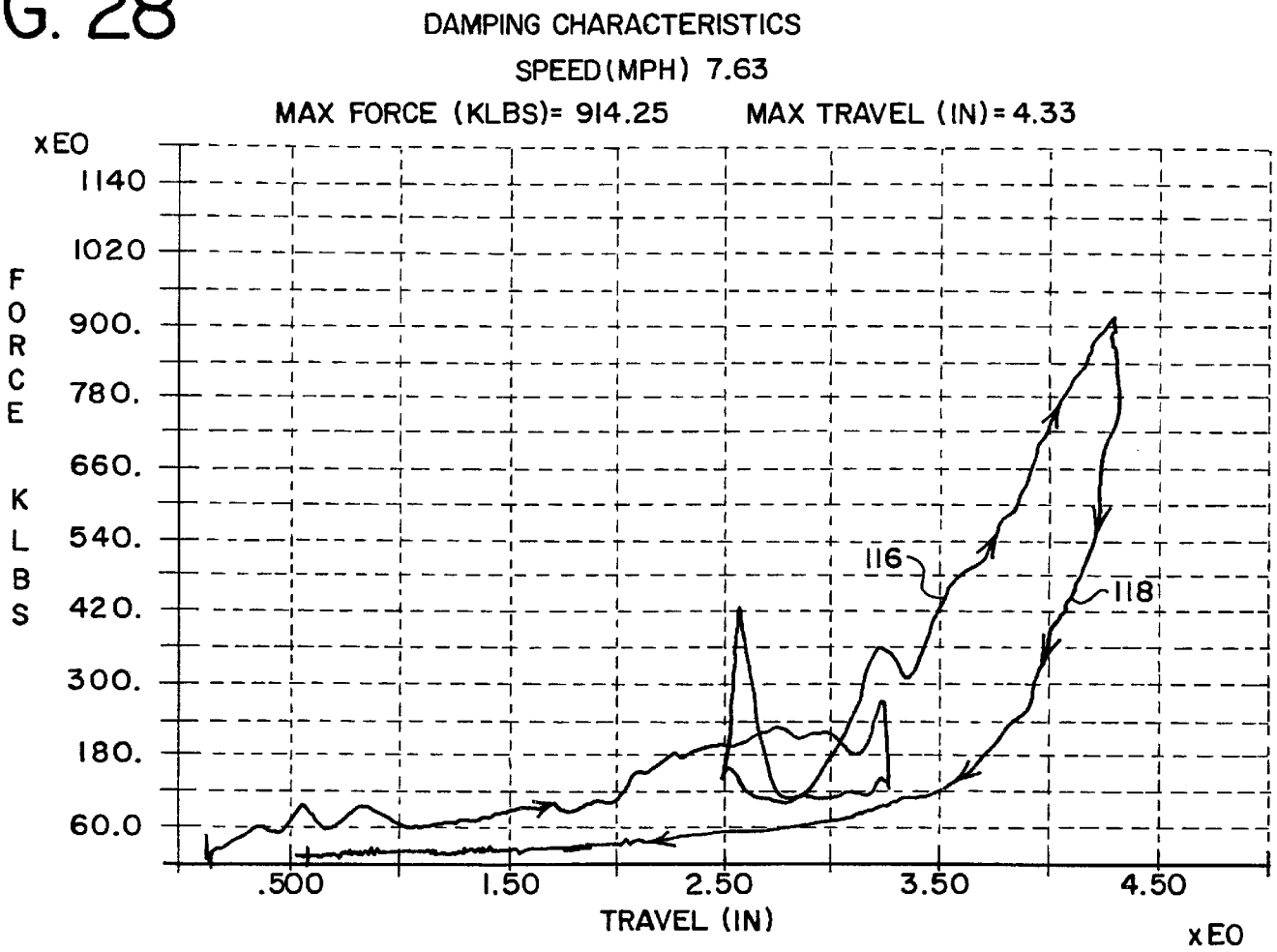
FIG. 28 is a graph showing the dynamic impact plots for buff impact of a draft gear assembly utilizing the principles of the present invention, with front and back resilient members operating in series, an impact speed of 7.63 mph, a maximum impact force of 914,250 pounds, and maximum coupler head travel of 4.33 inches.

An example of static closure characteristics or spring rates for the resilient members 28, 30 are illustrated in FIG. 23. The left static closure curve 110 shows force versus travel for a stack of four elastomer pad members, such as could be used for the front resilient member 28. Essentially, the curve 110 shows a possible spring rate curve for one possible front resilient member 28. The middle static closure 112 curve shows force versus travel for a stack of ten elastomer pad members, as could be used for the back resilient member 30. Essentially, the curve 112 shows a possible spring rate curve for one possible back resilient member 30. The right static closure curve 114 shows force versus travel for a stack of fourteen elastomer pad members, such as would result from use of the front and back resilient members 28, 30 in series. Essentially, the curve 114 shows a possible spring rate curve for possible front and back resilient members 28, 30 operating in series. As shown in FIG. 23, the front resilient member 28 may be stiffer than the back resilient member 30: a front pad stack of 4 pads (two end pads and three intermediate pads) could move 1.25 inches in response to 1,000,000 pounds of force; a back pad stack of 10 pads could move 3 inches in response to 1,000,000 pounds of force; and a pad stack of 14 of these pads in series could move 4.25 inches in response to 1,000,000 pounds of force.

The front and back resilient members 28, 30 are compressible along the longitudinal axes of the resilient members 28, 30, which axes are co-incident with the central longitudinal axis of the center rod 34. The uncompressed lengths of the front and back resilient members in the illustrated embodiment are about 6 inches and 15⅝ inches, respectively. The installed lengths of the front and back resilient members may be, for example, 4.875 inches and 13.375 inches respectively for the pad stacks shown in FIG. 23. Alternatively, the installed length for the back resilient member could be 13.125 inches. These pre-compressions give these pad stacks pre-loads. The pre-load for a front pad stack at this installed height may be 15,000 pounds, for example; the pre-load for a back pad stack at either of these heights may be 25,000–30,000 pounds, for example. It should be understood that once assembled together, the yoke will move slightly, changing the height of the pad stack as the loads in the two resilient members 28, 30 reach equilibrium. In the neutral position shown in FIGS. 3–4 and 13–14, it may be expected that the loads in the two resilient members 28, 30 will be substantially equal, and the heights of the pad stacks will vary accordingly. Prior to installation, in the form shown in FIGS. 5–6, 15–16 and 19–20, the pre-load in the front pad stack may be 15,000 pounds, for example, and the pre-load for the back pad stack may be about 30,000 pounds; these pre-loads will reach equilibrium after the gag falls out in use.

Preferably, the material selected for the front and back resilient members 28, 30 provides a substantially constant pre-load over the useful life of these elements, although some pre-load loss can be expected. Preferably, the pre-load is not reduced by more than 28% over a ten year life span. In addition, the compression set, that is the overall loss in height of the damping member after a few compressions, does not exceed 6–10% of the design height of the stack. Generally, after a number of cycles, the spring rate will follow the curves shown in FIG. 23. It should be understood that the invention is not limited to such materials; one may design the system to accommodate other pre-load reductions and compression sets if desired.

As discussed below, in buff the front and back resilient members 28, 30 operate in series. A draft gear assembly using resilient members as described above in series may react to buff impacts in the manner shown in FIGS. 24–29. FIGS. 24–29 are dynamic impact plots for buff impact of a draft gear assembly utilizing the principles of the present invention, with front and back resilient members operating in series, and using an elastomer material that has hysteresis. In each graph, the upper curve 116 illustrates the action of the two resilient members 28, 30 during compression, and the lower curve 118 indicates the two resilient members 28, 30 during expansion following the compression. The complete cycle of compression and expansion in response to a buff impact comprises a hysteresis loop, with energy being dissipated during the cycle. With such energy dissipation, the elastomer stacks operate not only as springs, but also as damping members. Thus, FIGS. 24–29 show an example of damping characteristics for a suitable material.

It should be understood that the hysteresis loops of FIGS. 24–29 are provided by way of example only. A different pre-load on the pad stacks may shift the curves somewhat, and different materials may have different hysteresis loops. In addition, it may be desirable to vary the material, pad height or other characteristic so that the total buff travel is at most 4.25 inches at 1 million pounds of force and a speed of 8 mph. The present invention is not limited to any material providing any particular hysteresis loop, damping characteristic or preload unless expressly set forth in the claims. Although materials with hysteresis are desirable in that they provide a force damping function, materials with only marginal hysteresis, and not providing any appreciable damping, should be understood as falling within the expression "resilient member". The expression "resilient member" is intended to encompass elements that serve the functions of both springs and force dampers, as well as materials that provide the spring function but not a force damping function; the force damping function could be provided by a separate element.

Other types of resilient members may be used. Instead of a stack of elastomer pads, it may be desirable to use buff media having a greater spring rate. Moreover, one or more friction spring elements could be used as the front or back resilient member 28, 30. Friction springs generally have a plurality of interfitted circular rings with engaged conical friction surfaces. During impact, the rings are stressed and slide against one another. Impact energy is stored and dissipated. In addition, instead of elastomers, compressible fluids, liquid elastomers or hydraulics could be used as part of the resilient members. Synthetic and natural elastomers can be used, as well as combinations of elastomers and other materials such as metal. Other energy absorption media that are developed in the future may be used. Finally, the front and rear damping members need not be made of the same material.

The draft gear assemblies are assembled into the structures illustrated in FIGS. 5–6, 15–16 and 19–20 by inserting the center rod 34 through the hole 64 in the back wall of the yoke 24F, 24E or 24R until the head 70 of the center rod 34 is received in the countersink in the back wall of the yoke. The rear pad stack or back resilient member 30 is then placed on the stem of the center rod 34 and the rear follower 32 is then placed on the end of the center rod 34. The threaded end of the center rod 34 extends out through the hole 80 in the rear follower 32. Next, the gag 38 is placed on the end of the center rod 34, and the nut 37 is then threaded onto the back end of the center rod 34 and tightened against the gag 38. As the nut 37 is tightened, the gag 38 pushes against the rear follower 32, compressing the back resilient member 30. The nut is tightened until the distance between the rear face 82 of the rear follower 32 and the back face of the yoke stops 45, 47 is less than 24⅝ inches, the length of the draft gear pocket 18 so that the assembly can easily fit into the draft gear pocket.

The front resilient member 28 and the coupler follower 26F, 26E, 26R may be placed in the yoke 24F, 24E, 24R any time after the center rod 34 is placed through the back wall of the yoke. The front resilient member 28 may be compressed with a standard tool. The front resilient member 28 pushes against the front face 66 of the yoke back wall 44 and the back face 75 of the coupler follower 26F, 26E, 26R, pushing the coupler follower forward against the yoke stops 45, 47. The draft gear assembly 10F, 10E, 10R then appears as shown in FIGS. 5–6, 15–16 or 19–20.

The draft gear assembly 10F, 10E, 10R as shown in FIGS. 5–6, 15–16 or 19–20 may then be relatively easily installed in a draft sill 12 by placing the assembly 10F, 10E, or 10R into the draft gear pocket 18. Since the distance between the plane of the coupler follower stop contact surfaces 72 and the plane of the rear follower contact surfaces 82 is slightly less than the length of the draft gear pocket 18, the assembly 10F, 10E, 10R may be installed without additional effort to compress the pad stacks 28, 30.

Once the draft gear assembly 10F, 10E or 10R is in place in the draft sill 12, a standard support member may be attached to the draft sill flanges to support the weight of the draft gear assembly. The coupler may then be connected to the yoke 24F, 24E, or 24R by inserting the pin or key 52 or 59 through the aligned holes or slots 48 or 58 of the yoke. Since the holes or slots 48, 58 of the yoke are elongated, and since the yoke stops 45, 47 restrain forward movement of the coupler follower 26F, 26E, 26R, the pin or key 52, 59 may be inserted without first further compressing the front resilient member 28. The sizes of the holes or slots 48, 58 and positions of the yoke stops 45, 47 and draft sill front stops 14 are such as to prevent the coupler follower and resilient members 28, 30 from axially loading the coupler shank. The entire draft system is then ready for service.

An initial buff impact experienced by the draft system pushes the yoke 24F, 24E, 24R and front resilient member 28 back, thereby also pushing the center rod 34 back. As the center rod is pushed back, the space between the nut 37 and the back face 82 of the rear follower 32 increases and the gag 38 falls out. With the gag 38 gone, the back resilient member 30 and front resilient member 28 expand to the greatest extent allowed by the draft sill rear stops 16 and front stops 14. The resilient members 28, 30 expand, pushing the yoke forward until the stop contact surfaces 72 of the coupler follower 26F, 26E, or 26R are biased against the draft sill front stops 14 and the stop contact surfaces 86 of the rear follower 32 are biased against the contact surfaces of the draft sill rear stops 16. The draft system is then in the neutral position as shown in FIGS. 3–4 and 13–14. The front and back resilient members 28, 30 do not place any axial load on the coupler shank; the coupler shank may be slightly spaced from the coupler follower.

To reach the neutral position, the pre-loads in the front and back resilient members 28, 30 will reach an equilibrium, and the yoke 24F, 24E, 24R will move longitudinally accordingly. At the equilibrium position, the pre-load may be, for example, 25,000–30,000 pounds in both resilient members 28, 30. It should be understood that these pre-loads are identified for purposes of illustration only and that the present invention is not limited to any particular pre-load unless expressly set forth in the claims. Dimensions of parts such as the yoke back wall 44 and the rear follower 32 can be changed to change the distances shown at d6 and d7 to thereby adjust the degree of compression of the resilient members 28, 30 to adjust the pre-load.

When the pre-loads in the front and back resilient members 28, 30 have reached equilibrium, the front resilient member 28 has a length shown at d3 in FIGS. 4 and 14, and the back resilient member 30 has a length shown at d4 in FIGS. 4 and 14. The coupler horn 23 is spaced from the front 21 of the draft sill or striker a distance shown at d5 in FIGS. 3 and 14. Examples of lengths and distances are: 4⅞ (4.88) for d3; 13⅛ (13.13) for d4; and 4¾ (4.75) for d5. In addition to pre-load, these distances can be expected to vary depending on factors such as compression set and pre-load loss. Moreover, as the two resilient members reach equilibrium, d3 may be expected to be slightly less and d4 may be expected to be slightly greater.

With the shape of the coupler followers 26F, 26E and 26R of the present invention, the contact surface 74 of the coupler 22F, 22E, 22R is offset forwardly by about 1¼ inches. The coupler is also offset forward by a distance of about 1¼ inches.

When a draft load, that is, a load tending to pull the coupler in a longitudinally outboard direction, greater than about 25,000–30,000 pounds is experienced, the coupler 22F, 22E or 22R moves longitudinally outboard toward the direction shown at 2 in FIGS. 1–4 and 11–14. The draft system should reach the full draft position shown in FIGS. 1 and 11 when the coupler receives a load of 650,000 pounds, nominally, in the illustrated embodiment. The coupler and the yoke both move in response to a draft impact. The full draft stroke for the coupler 22F, 22E and yoke 24F, 24E, 24R is 1¼ (1.25) inches, nominally.

In the full draft position, the coupler pulls against the coupler pin or key 52, 59 which pulls the yoke forward a distance of about 1.25 nominal inches, compressing the front resilient member 28 to a length shown at d6 in FIGS. 1 and 11. Simultaneously, the back resilient member 30 expands by 1¼ inches to a length shown at d7 in FIGS. 1 and 11. In the full draft position, the distance between the coupler horn 23 and the front end 21 of the draft sill 12 increases to the distance shown at d8 in FIGS. 1 and 11. In the full draft position, the rear follower surfaces 86 remain pressed against the front faces of the draft sill rear stops 16, and the coupler follower stop surfaces 72 remain pressed against the back faces of the draft sill front stops 14. Thus, the rear follower and coupler follower do not move in response to a draft impact. And since the back resilient member 30 expands to maintain contact with the yoke and the rear follower during the draft stroke, there is no slack between the coupler follower and the rear follower in draft. Examples of values for the lengths and distances at full draft are: 3⅝ (3/63) inches for d6; 14⅜ (14.38) inches for d7; and 6 inches for d8.

When the draft load is removed, the front resilient member 28 expands, and the coupler and yoke return to the neutral position shown in FIGS. 3–4 and 13–14. The lengths of the pad stacks 28, 30 return to the neutral lengths d3, d4 as well.

Figure 2:
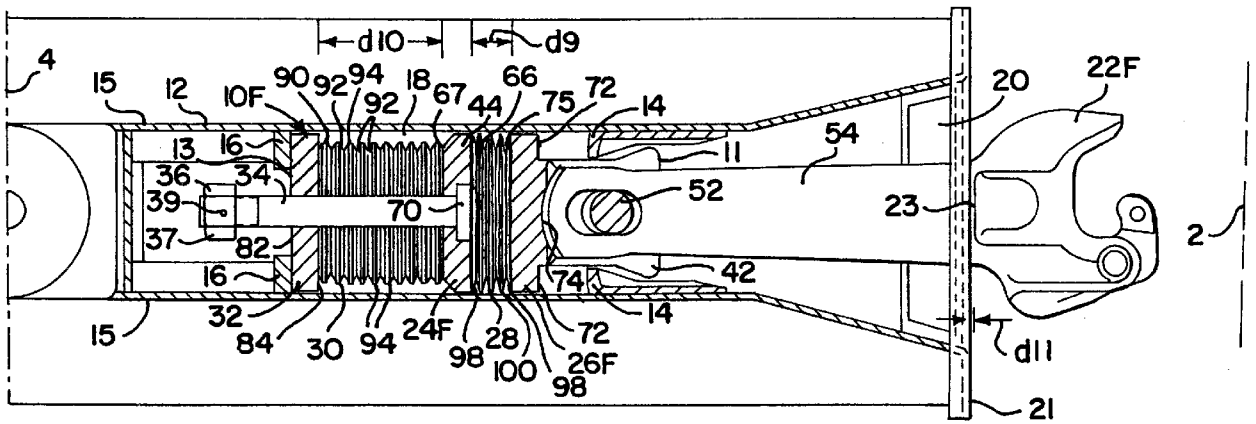
FIG. 2 is a top plan view of the combination F-shank draft gear assembly, draft sill and F shank coupler of FIG. 1, the coupler and draft gear assembly being shown in the full buff position, and with parts shown in cross-section.

When the coupler experiences a buff load, that is, a load pushing the coupler in the inboard direction toward the reference 4 in FIGS. 1–4 and 11–14, the butt end of the coupler shank 54, 60 pushes against the coupler follower 26F, 26E or 26R, pushing the coupler follower back if the load exceeds 25,000–30,000 pounds. As the coupler follower is pushed back, it compresses the front resilient member 28 against the back wall 44 of the yoke, and the front resilient member 28 pushes the yoke back wall 44 back to compress the back resilient member 30. The full buff position of the draft gear assembly is reached under a compressive load of 1,000,000 pounds, nominally. This full buff position is shown in FIGS. 2 and 12.

At the full buff position, the length of the front resilient member 28 is compressed by 1¼ inches the length shown at d9 in FIGS. 2 and 12. At the full buff position, the length of the back resilient member 30 is compressed by 3 inches to the length shown at d10 in FIGS. 2 and 12. Thus, the total buff stroke for the coupler 22F, 22E, 22R and coupler follower 26F, 26E, 26R is 4¼ (4.25) inches, and the total buff stroke for the yoke 24F, 24E, 24R is 3 inches. Accordingly, the distance between the coupler horn 23 and the front 21 of the draft sill 12 is shortened to d11 at the full buff position. Examples of values for the lengths and distances at full buff are: 3⅝ (3.63) inches for d9; 10⅛ (10.13) inches for d10; and ½ inch for d11.

Figure 29:
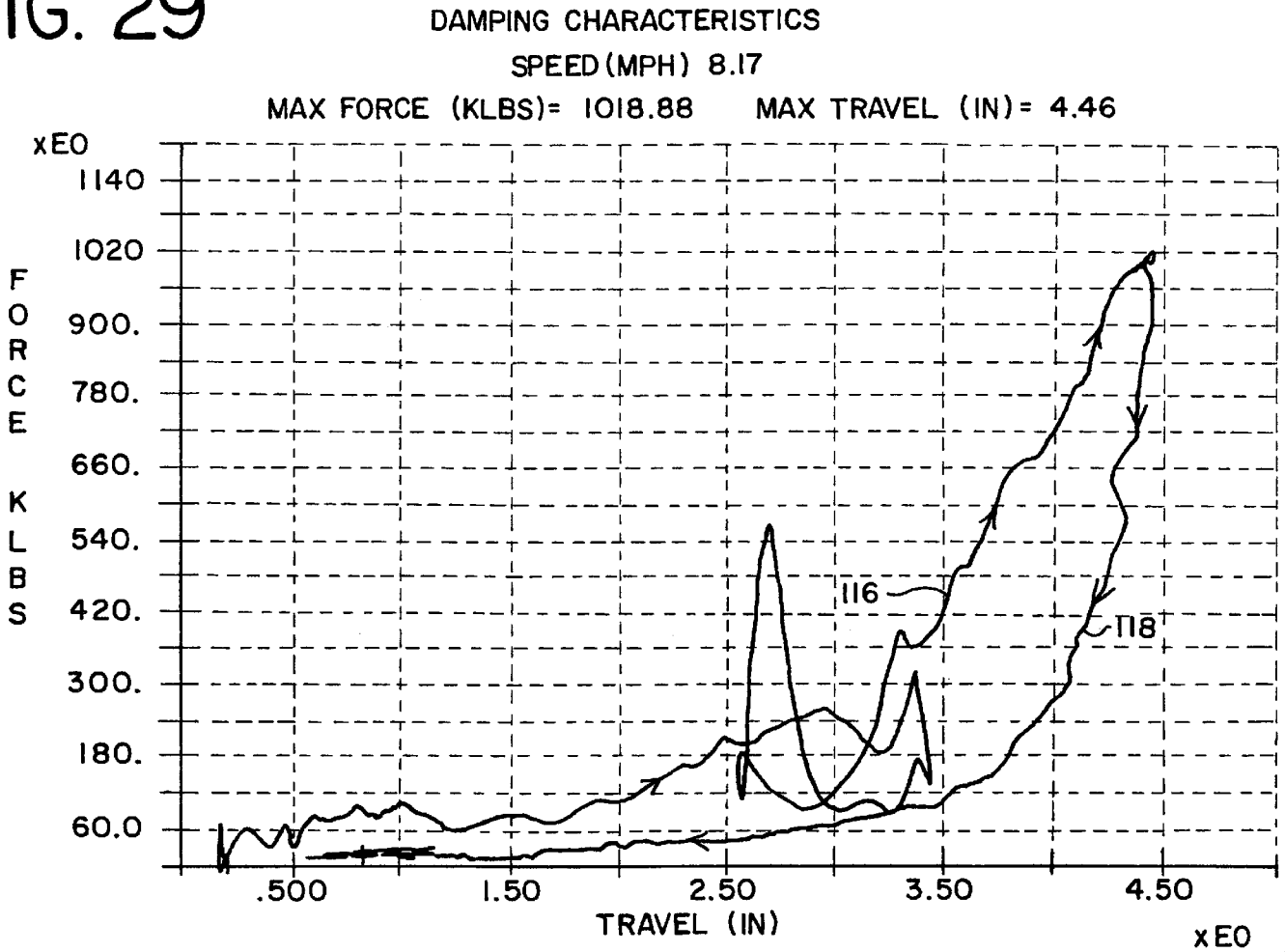
FIG. 29 is a graph showing the dynamic impact plots for buff impact of a draft gear assembly utilizing the principles of the present invention, with front and back resilient members operating in series, an impact speed of 8.17 mph, a maximum impact force of 1,018,880 pounds, and maximum coupler head travel of 4.46 inches.

It should be understood that under extremely high loads or at relatively high speeds, the coupler may continue to move back through the last ½ inch, and may contact the striker on the front end 21 of the draft sill 12. Accordingly, although it is generally undesirable in this design, the coupler head could have a full buff stroke of 4¾ inches, nominally. Thus, as shown in FIG. 29, the distance traveled by the coupler during the full buff stroke may exceed the 4.25 inches of buff travel provided by the draft gear assembly. The expression "full buff position" should be understood to encompass a coupler buff stroke of 4¼ to 4¾ inches.

It should also be understood that the dimensions, lengths and distances set forth above are nominal ones. Normal manufacturing tolerances may vary these dimensions, lengths and distances. Dimensions, lengths and distances stated in this description and in the claims should be understood to include variations due to normal tolerances. In addition, unless expressly set forth in the claims, the invention is not limited to any particular dimension, length or distance.

Compression setting of the resilient members 28, 30, may affect the length of the draft stroke and buff stroke. Accordingly, references to the length of the buff or draft stroke of any part in the claims should be understood as referring to a design value, a value that may change over time with use and wear. Thus, reference to a full draft position or draft stroke of 1¼ inches should be understood as including positions and draft strokes that vary from this length with compression set and loss of pre-load.

Throughout buff movement of the draft system coupler and yoke, there is no contact between the coupler pin or key 52, 59, and the yoke 24F, 24E, 24R. The coupler pin or key 52, 59 is thus not stressed during buff movement of the yoke 24F, 24E, 24R. It is only during draft movement of the yoke that the yoke contacts the coupler pin or key.

The front and back resilient members 28, 30 bias the coupler follower 26F, 26E, 26R forward toward the yoke top and bottom stops 45, 47, toward the draft sill front stops 14, and toward the butt end of the coupler shank 54, 60. There is a small amount of slack between the coupler follower and the butt end of the shank in the illustrated embodiments at the neutral position and during draft movement of the coupler and yoke. The rear follower 32 remains biased against the rear stops 16 of the draft sill 12 throughout the range of motion of the other elements of the draft system. Thus, the draft gear assembly of the present invention is substantially slack free in the pocket in draft. However, in the situation where a draft event follows a buff event, it is expected that there will be some slack in the system at the start of the draft event.

The small amount of slack between the coupler follower and butt end of the shank is desirable to prevent axial loading of the butt end of the shank. Such loading could cause undesirable friction which could inhibit turning of the coupler shank. This slack accounts for some of the movement shown in FIGS. 24–29 at low loads.

Once the gag 38 falls from the system, the center rod 34 is free from stress. At the full draft position, the nut 37 is spaced slightly from the back face 82 of the rear follower 32, so there is no tension on the center rod 34. At the full buff position, the center rod 34 moves rearward with the yoke, but the rear end of the center rod 34 does not contact any other element; the center rod 34 is free from compressive stress. At the neutral position, the center rod 34 is free from tension and compression. Although free from tension and compression, the center rod 34 functions to guide the back resilient member 30 to prevent buckling of the back resilient member 30.

It should be understood that the yokes 24F, 24E, 24R could be made without the top and bottom stops 45, 47. Instead, the yoke could be provided with shear pins that hold the coupler follower in position during initial assembly, and that shear off after some initial shock so that the coupler follower bears directly against the butt of the coupler shank. However, the stops 45, 47 are desirable in that they simplify removal of the draft gear assembly from the draft sill.

To remove the assembly for replacement, a pillow-block collar can be installed at the rear follower, over the extended center rod, and the nut can be tightened to compress the buff pad stack. Then, a standard draft gear removal tool can be used to push the front follower off of the front stop 14, enabling the draft gear assembly to be dropped out of the draft gear pocket.

The draft gear assembly and system of the present invention offers several advantages. The draft gear assembly of the present invention provides for relatively long travel in buff—4.25 inches—while utilizing the same available standard draft gear pocket, and without modifying the draft gear pocket. The draft gear assembly of the present invention also has separate draft and buff capacities. In buff, the two resilient members 28, 30 work in series to provide the total buff travel capacity of 4.25 inches while only one energy absorber works in draft. In addition, the elongated key slot or pin hole in the yoke allows for full buff travel without loading the pin or key. In draft there is a shorter travel of 1.25 inches; since excessive movement in the draft direction contributes to the severity of the shocks, the present invention provides a compromise between absorbing the energy of draft shocks and limiting the amount of movement in the connection. And since the rear energy absorber should expand to fill any gap during draft impacts, free slack normally created by pulling the train will not exist.

In addition, installation, removal and coupler change-out may be accomplished without any special tools. The center rod and shortening member allow the assembly to be pre-shortened to easily fit within the draft gear pocket. The larger slot or hole allows the pin or key to be slipped through the aligned slots or holes without pre-shortening the front pad stack 28. And removal can be accomplished with standard equipment already typically available.

It should be understood that although advantages of the illustrated embodiments have been identified, it is not necessary that all of the possible advantageous features of the present invention be used. Individual features of the invention may be employed without using other features. The claims should not be interpreted as requiring a particular feature or advantage unless expressly set forth in the claim.

While only specific embodiments of the invention have been described and shown, it is apparent that various alterations and modifications can be made therein. For example, instead of a separate yoke and coupler follower with a force absorbing element between them, a combination yoke and follower could be used, with a pair of laterally spaced force dampers in front of the yoke/follower and behind the draft sill stops. It is, therefore, the intention in the appended claims to cover all such modifications and alterations as may fall within the scope and spirit of the invention. Moreover, the invention is intended to include equivalent structures and structural equivalents to those described herein.

We claim:

1. In combination, a draft gear assembly, a coupler and a draft sill, the draft sill having a pair of front stops and a pair of rear stops;

the draft gear assembly having front and back ends and comprising;

a yoke having a back wall, a top wall extending from the back wall toward the front end of the draft gear assembly, and a bottom wall extending from the back wall toward the front end of the draft gear assembly;

the back wall of the yoke being between the front and rear stops of the draft sill;

a coupler follower positioned between the back wall of the yoke and the front stops of the draft sill, the coupler follower including a pair of stop contact surfaces for contact with the draft sill front stops and a coupler bearing surface between the stop contact surfaces, at least a part of the coupler bearing surface being forward of the stop contact surfaces of the coupler follower, a rear follower longitudinally spaced from the yoke back wall;

at least one front resilient member filing the longitudinal distance between the coupler follower and the back wall of the yoke;

at least one back resilient member filling the longitudinal distance between the rear follower and the back wall of the yoke;

a center rod extending through the rear follower, back resilient member and back wall of the yoke;

a coupler extending forward from the yoke, the coupler having a neutral position, a full draft position forward of the neutral position and a full buff position back from the neutral position;

wherein the rear follower is positioned against the rear stops of the draft sill when the coupler is at the full buff position, at the full draft position and at the neutral position.

2. The combination of claim 1 wherein the draft gear assembly comprises an assembly prior to installation in the draft sill, the assembly further including a shortening member associated with the center rod to compress the back resilient member.

3. The combination of claim 1 wherein the coupler has a maximum draft stroke of 1¼ inches and a maximum buff stroke of at least 4¼ inches, and wherein the longitudinal distance between the front stops and the rear stops of the draft sill is 24⅝ inches.

4. The combination of claim 1 wherein there is no housing between the resilient members and the draft sill.

5. A draft gear assembly for use with railcars having coupler members, the draft gear assembly having front and back ends and comprising:

a yoke having a back wall, a top wall extending from the back wall toward the front end of the draft gear assembly, and a bottom wall extending from the back wall toward the front end of the draft gear assembly;

a coupler follower positioned between the back wall of the yoke and the front end of the draft gear assembly;

at least one front resilient member positioned between the coupler follower and the back wall of the yoke;

at least one back resilient member positioned between the yoke back wall and the back end of the draft gear assembly;

the front and back resilient members being compressed in a buff loading, and the front resilient member being compressed in a draft loading, a rear follower positioned rearward of the back resilient member, a center rod extending from the rear follower through the back resilient member and through the back wall of the yoke, wherein prior to installation on the railcar the yoke, coupler follower, front resilient member, rear follower and center rod comprise an assembly, the assembly further including a shortening member on the center rod at the rear follower, the length of the assembly from the coupler follower to the rear follower being less than 24⅝ inches;

wherein the yoke has a buff stroke;

and wherein after installation on the railcar the center rod is free from tension when the yoke is moving through the draft stroke and free from compression when the yoke is moving through the buff stroke.

6. The draft gear assembly of claim 5 wherein the yoke has a neutral position, a full draft position about 1¼ inches forward of the neutral position, and a full buff position about 3 inches rearward of the neutral position.

7. The draft gear assembly of claim 5 wherein the coupler follower has a buff stroke of 3¼ to 4¼ inches and the yoke has a draft stroke of about 1¼ inches.

8. The draft gear assembly of claim 5 in combination with a draft sill having front stops, rear stops and a draft pocket between the front stops and the rear stops, and wherein:

the rear follower is positioned against the rear stops throughout buff and draft movement of the coupler follower; and the coupler follower is positioned against the front stops at the neutral position.

9. The combination draft gear assembly and draft sill of claim 8 wherein the draft pocket has a length of about 24⅝ inches.

10. The draft gear assembly of claim 5 in combination with a draft sill having walls defining a draft pocket, wherein at least the front and back resilient members are received in the draft gear pocket, and wherein the combination is free from any housing between the draft sill walls and the front and back resilient members.

11. The draft gear assembly of claim 5 wherein the yoke includes a top stop and a bottom stop, the coupler follower being biased against the top and bottom stops.

12. A draft gear assembly for use with a railcar having a coupler member and a draft sill with front and rear stops defining a draft gear pocket to receive at least part of the draft gear assembly, the draft gear pocket having a length between the front stops and rear stops, the draft gear assembly having front and back ends and comprising:

a yoke having a back wall, a top wall extending from the back wall toward the front end of the draft gear assembly, and a bottom wall extending from the back wall toward the front end of the draft gear assembly;

a coupler follower positioned between the back wall of the yoke and the front end of the draft gear assembly, the coupler follower having a forward facing stop surface;

at least one front resilient member positioned between the coupler follower and the back wall of the yoke;

at least one back resilient member positioned between the yoke back wall and the back end of the draft gear assembly;

wherein the front and back resilient members are compressed in a buff loading and the front resilient member is compressed in a draft loading, a rear follower positioned rearward of the back resilient member, the rear follower having a rearward facing stop surface;

a center rod extending through the rear follower, through the back resilient member and through the back wall of the yoke;

wherein prior to installation on the railcar the yoke, coupler follower, front resilient member, back resilient member, rear follower and center rod comprise an assembly, the assembly further including a shortening member on the center rod at the rear follower, the length of the assembly between the stop surface of the coupler follower and the stop surface of the rear follower being less than the length of the draft gear pocket;

wherein after installation on the railcar the rear follower is positioned against the rear stops; and wherein after installation on the railcar the yoke has a neutral position, a full draft position forward of the neutral position, and a full buff position rearward of the neutral position;

the center rod being free from tension when the coupler member is in the full draft position;

the center rod being free from tension and compression when the coupler member is in the neutral position; and the center rod being free from compression when the coupler member is in the full buff position.

13. The draft gear assembly of claim 12 wherein the shortening member comprises a nut on the end of the center rod and a removable gag inward of the nut.

14. The draft gear assembly of claim 12 wherein the distance between the stop surface of the rear follower and the stop surface of the coupler follower is less than 24⅝ inches prior to installation of the assembly on the railcar.

15. The draft gear assembly of claim 14 wherein the yoke includes top stops and bottom stops limiting forward movement of the coupler follower.

16. The draft gear assembly of claim 12 in combination with a draft sill having walls defining a draft pocket, wherein at least the front and back resilient members are received in the draft gear pocket, and wherein the combination is free from any housing between the draft sill walls and the front and back resilient members.

17. The combination draft gear assembly and draft sill of claim 16 in combination with a coupler, the coupler having a draft stroke of about 1¼ inches and a buff stroke of at least 3¼ inches.

18. The combination draft gear assembly and draft sill of claim 16 wherein the length of the back resilient member is greater after installation in the draft sill than prior to installation.

* * * * *